US009556881B2

(12) United States Patent
Seiji et al.

(10) Patent No.: US 9,556,881 B2
(45) Date of Patent: Jan. 31, 2017

(54) PROPELLER FAN

(71) Applicant: SAMSUNG ELECTRONICS CO., LTD., Suwon-si, Gyeonggi-do (KR)

(72) Inventors: Sato Seiji, Osaka (JP); Suguru Nakagawa, Osaka (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 648 days.

(21) Appl. No.: 14/033,635

(22) Filed: Sep. 23, 2013

(65) Prior Publication Data

US 2014/0086754 A1 Mar. 27, 2014

(30) Foreign Application Priority Data

Sep. 24, 2012 (JP) ..... 2012-209744
Nov. 26, 2012 (JP) ..... 2012-257610
Jul. 31, 2013 (KR) ..... 10-2013-0091122

(51) Int. Cl.
*F04D 29/38* (2006.01)
*F04D 29/32* (2006.01)

(52) U.S. Cl.
CPC ..... *F04D 29/325* (2013.01); *F04D 29/384* (2013.01); *F05D 2240/304* (2013.01)

(58) Field of Classification Search
CPC F04D 29/325; F04D 29/384; F05B 2240/301; F05D 2240/304
See application file for complete search history.

(56) References Cited

U.S. PATENT DOCUMENTS 8,007,243 B2 * 8/2011 Arinaga ..... F04D 29/384 415/119

FOREIGN PATENT DOCUMENTS

| | | | |
|---|---|---|---|
| CN | 101023271 | 8/2007 | |
| CN | 101334043 | 12/2008 | |
| CN | 101688540 | 3/2010 | |
| JP | 2002-70504 | 3/2002 | |
| JP | 2002-106494 | 4/2002 | |
| JP | EP 2607714 A2 * | 6/2013 | ..... F04D 29/384 |

OTHER PUBLICATIONS

Chinese Office Action dated Sep. 2, 2016 from Chinese Patent Application No. 201310437318.1, 14 pages.

* cited by examiner

*Primary Examiner* — Eric Keasel
*Assistant Examiner* — Jason Davis
(74) *Attorney, Agent, or Firm* — Staas & Halsey LLP

(57) ABSTRACT

A propeller fan may strongly draw the flow toward the inner circumferential side and greatly improve the pressure efficiency by degrading the tendency of the flow near the pressure surface to be inclined toward the outer circumferential side at the trailing edge of the blade. The blade is provided with a recessed portion raised toward a suction surface at a central portion of a trailing edge of the blade in a radial direction such that the recessed portion is open at least on a pressure surface of the blade, the recessed portion extending from the trailing edge toward a leading edge of the blade, and a cross section of the recessed portion taken in a radial direction is provided with a pair of lateral portions rising at a predetermined angle with respect to the suction surface and facing each other. The span-wise width of the recessed portion between the lateral portions increases as the recessed portion extends from an upstream side to a downstream side.

27 Claims, 34 Drawing Sheets

(a)

(b)

PROPELLER FAN

CROSS-REFERENCE TO RELATED APPLICATIONS

This application claims the benefit of Japanese Patent Application No. 2012-209744, filed on Sep. 24, 2012 in the Japanese Patent Office, Japanese Patent Application No. 2012-257610, filed on Nov. 26, 2012 in the Japanese Patent Office, and Korean Patent Application No. 2013-0091122, filed on Jul. 31, 2013 in the Korean Intellectual Property Office, the disclosures of which are incorporated herein by reference.

BACKGROUND

1. Field

Embodiments of the present invention relate to a structure of blades of a propeller fan used for an air conditioner.

2. Description of the Related Art

As shown in FIG. 1, when a typical blade 110A formed in a smoothly curved shape over the entire body thereof without a projection or a recessed portion thereon rotates, the air stream near the blade pressure surface 104A is inclined toward the outer edge of the blade at the blade outlet (the blade trailing edge 103A) by centrifugal force. Due to the incline stream, the stream near the cylindrical hub 111A at the center of the fan is likely to become unstable, degrading the pressure efficiency.

To address this situation, an attempt has been made to create uniform distribution of the stream in a radial direction by forming a swollen portion 106B near the blade trailing edge 103B of the propeller fan 100B such that the swollen portion 106B is swollen in an arc shape and thus convex toward the suction surface 105B and facilitating outflow from the swollen portion 106B, as shown in FIG. 2.

However, in the case that a portion of the blade trailing edge 103B is formed to be swollen, the cross section of this portion of the blade taken at the same radial distance from the center forms a line smoothly curved over the chord of the blade in the rotational direction. Accordingly, a recognizable portion of the stream that is not propelled by the blade may be produced at the trailing edge 103B of the blade, resulting in lower air blowing. In addition, since the trailing edge 103B of the blade has an arc-shaped swollen portion 106B and the air smoothly flows to this portion in a perpendicular approximately perpendicular to the arc, the force to attract the outwardly inclined airstream inward is weak. Therefore, the conventional propeller fan may not greatly increase the pressure efficiency.

SUMMARY

Therefore, it is an aspect of the present invention to provide a propeller fan which may greatly increase the air blowing power by reducing the tendency of the air stream on the pressure surface to be inclined to the outer circumferential side at the blade trailing edge portion and strongly attracting the airstream to the inner circumferential side.

It is another aspect of the present invention to provide a propeller fan which may improve the propulsive power of the blade and reduce leaking airstreams at the outer circumferential portion of the blade, thereby suppressing development of vortices at the blade edges and improving the fan efficiency.

Additional aspects of the invention will be set forth in part in the description which follows and, in part, will be obvious from the description, or may be learned by practice of the invention.

In accordance with one aspect of the present invention, a propeller fan including a plurality of blades radially arranged on an outer circumferential surface of a cylindrical hub and spaced a predetermined distance from each other in a circumferential direction of the hub, wherein each of the blades is provided with a recessed portion raised toward a suction surface at a central portion of a trailing edge of the blade in a radial direction such that the recessed portion is open on a pressure surface of the blade, the recessed portion extending from the trailing edge toward a leading edge of the blade, and a cross section of the recessed portion taken in a radial direction is provided with a pair of lateral portions rising at a predetermined angle with respect to the suction surface and facing each other, wherein a span-wise width of the recessed portion between the lateral portions gradually increases as the recessed portion extends from an upstream side to a downstream side.

In the configuration as above, the recessed portion is provided with a pair of lateral portions rising at a predetermined angle with respect to the suction surface and facing each other, and thus curvature greatly changes between the suction surface and the recessed portion. Accordingly, force to draw the flow near the pressure surface into the recessed portion may be increased.

In addition, since the span-wise width between the lateral portions gradually increases as the recessed portion extends from an upstream side to a downstream side, a greater angle may be made between the direction of extension of the lateral portions and the flow along the pressure surface prior to introduction into the recessed, and due to the tendency of the flow to be perpendicularly introduced into the recessed portion with respect to the lateral portions, it may be possible to greatly change the direction of the flow near the outer circumference.

Thereby, the flow near the pressure face may be easily drawn into the recessed portion, and the direction of the flow directed to the outer circumferential side may be greatly changed to the inner circumferential side. Therefore, almost uniform distribution of flow at the trailing edge on the pressure surface may be created. Particularly, the flow at the inner circumferential side may be prevented from being destabilized to cause noise or vibration, and therefore pressure efficiency may be enhanced.

When an outer diameter of the blade is defined as Rt with respect to an axis of rotation of the fan, an inner diameter of the blade as Rh, a radius to an end of one of the lateral portions arranged closer to an inner diameter side at the trailing edge of the blade as Ri, and a radius to an end of the other one of the lateral portions closer to an outer diameter side and arranged at the trailing edge of the blade as Ro, the recessed portion may be formed such that $Ri=Rh+\alpha(Rt-Rh)$ and $Ro=Rh+\beta(Rt-Rh)$, where $0.2\leq\alpha\leq0.6$, $0.6\leq\beta\leq30.9$. As the recessed portion is formed at a position where centrifugal flow likely to be inclined toward the outer circumference by centrifugal force produced by rotation of the propeller fan, the tendency of the flow may be effectively suppressed.

When an inclination angle of one of the lateral portions positioned at an inner diameter side with respect to an axis of rotation of the fan is defined as $\theta i$, and an inclination angle of the other one of the lateral portions positioned at an outer diameter side with respect to an axis of rotation of the fan is defined as $\theta o$, the recessed portion may meet the conditions of $5°\leq\theta i\leq60°$, $5°\leq\theta o\leq60°$, and $\theta i\geq\theta o$. Thereby, the airstream flowing along the pressure surface may be easily introduced into the recessed portion provided to the blade, and the two vortices created along the lateral portions become almost balanced, thereby enhancing the pressure efficiency.

In a cross section of the recessed portion taken, at a radius where a proximal end of the recessed portion with respect to the leading edge is positioned, along a circumferential direction and, a length of the recessed portion from the trailing edge to the proximal end of the recessed portion (L1) is set to be approximately 10% to 60% of a length of a chord of the blade (L0). Thereby, the flow may be smoothly introduced into the recessed portion from the upstream side to the downstream side. In addition, as the exit angle of the recessed portion is made to almost coincide with the exit angle of the other portion adjacent to the recessed portion, the flow may be uniformly distributed in a radial direction, enhancing the pressure efficiency.

In the cross section of the recessed portion taken at the radius where the proximal end of the recessed portion is positioned, a depth (d) of the recessed portion extending toward the suction surface may increase as the recessed portion extends from the upstream side to the downstream side, and the recessed portion may have a constant depth region near the trailing edge where the depth (d) is substantially constant as a predetermined depth (dx). Thereby, a proper step is formed between the recessed portion and the pressure surface, and therefore the airstream may be more securely introduced into the recessed portion. As a result, centrifugal flow may be suppressed and the pressure efficiency may be enhanced.

The recessed portion may be provided with a bottom portion formed at the suction surface sides of the lateral portions to close the recessed portion, wherein the bottom portion forms a curved surface approximately parallel to the suction surface. Thereby, degradation of strength of the blade according to formation of the recessed portion may be prevented, and the pressure efficiency may be enhanced.

The recessed portion may also be open on the suction surface to have an opening and configured only with the lateral portions. Thereby, longitudinal vortices may be created on the suction surface by the airflow introduced into the recessed portion. Accordingly, separation of flow near the suction surface may be prevented, and the pressure efficiency may be further enhanced. When the recessed portion is configured as above, air blowing effect is more or less degraded due to reduction of the area of the blade. Accordingly, to secure the same flow rate, the rate of rotation may need to be increased. However, since the airflow introduced into the recessed portion is increased, the pressure efficiency may be enhanced by the longitudinal vortices created on the suction surface, without increase of the rate of rotation.

The pressure surface may be connected to each of the lateral portions in a rounded fashion. Thereby, disturbance or loss of the flow introduced into the recessed portion provided to the blade may be suppressed, and thus the pressure efficiency may be further enhanced.

The upstream end of the opening of the recessed portion may be rounded. Thereby, concentration of stress at the upstream end of the recessed portion may be prevented to increase the strength of the blade. Accordingly, the blade may be prevented from being easily damaged.

The recessed portion may be provided with a filling portion formed by filling a gap between upstream ends of the lateral portions, wherein the filling portion forms the same curved surface with a portion of the pressure surface adjacent thereto. Concentration of stress at the upstream end of the recessed portion due to centrifugal force may be prevented, and thus the blade may be further prevented from being easily damaged.

According to an air conditioner using the propeller fan of the present invention as above, the air conditioner may be efficiently operated due to enhanced air blowing power.

That is, the blade may be provided with at least one open-cut portion formed by cutting off a trailing edge of the blade, wherein a profile of the open-cut portion is provided with a first arc swollen toward an inner circumference of the blade and a second arc swollen toward an outer circumference of the blade, wherein a leading end of the profile is formed by connection between a distal end of the first arc distant from the trailing edge portion and a distal end of the second arc distant from the trailing edge portion.

Since the profile of the open-cut portion forms the leading end at the ends of the first and second arcs, a first vortex and a second vortex starting from the leading end of the open-cut portion toward the trailing edge and spinning in the opposite directions may be created. Due to mutual interference between the first vortex and the second vortex spinning in the opposite directions, the propulsive power of the blade may be enhanced, suppressing degradation of air blowing performance resulting from decreased of the area of the blade.

Herein, the concept of arc includes a circular arc, an elliptic arc, and a portion of a parabola or a hyperbola.

When a center of rotation of the propeller fan is defined as O, a radius from the center of rotation O to the outer circumference of the blade as R1, a radius of the hub as R2, two connection points at which the trailing edge of the blade meets the profile of the open-cut portion as P and Q, one of the two connection points close to the center of rotation O being defined as P and the other one of two connection points distant from the center of rotation O being defined as Q, a length of line segment OP between the center of rotation O and point P as Rp, and a length of line segment OQ between the center of rotation O and point Q as Rq, the first arc and the second arc forming the profile of the open-cut portion may be formed such that $0.35(R1-R2)\leq(Rp-R2)<(Rq-R2)\leq(R1-R2)$. As the open-cut portion is arranged near the outer circumferential portion of the blade, leaking of airflow introduced from the pressure surface to the suction surface may be suppressed, and thus development of vortices at the blade tip may be suppressed.

The blade may be provided with only one of the at least one open-cut portion to secure a good aerodynamic performance. In the case that a plurality of open-cut portions is provided, vortices created between the open-cut portions may lower the speed of outflow, lowering improvement of the propulsive power of the blade.

The profile of the open-cut portion may be provided with a minute circular arc between the first and second arcs, the minute circular are being formed in consideration of dimensions of a smallest machining tool. Thereby, the first and second vortices may be efficiently created, contributing to further enhancement of the propulsive power of the blade.

A line segment between a point A dividing the first circular arc into two equal parts and a center of the first circular arc may cross a line segment between a point B dividing the second circular arc into two equal parts and a center of the second circular arc. Thereby, a proper distance between the first and second vortices may be maintained such that proper interference between the first and second vortices occurs.

The first and second arcs may be circular arcs, wherein a first tangent line to the first circular arc at a first connection point and a second tangent line to the second circular arc at a second connection point may make an angle respectively with imaginary tangent lines, at the first connection point and the second connection point, to imaginary circles passing through the first connection point and the second connection point and having a center thereof at a center of rotation of the propeller fan, the first circular arc meeting the trailing edge at the first connection point, the second arc meeting the trailing edge at the second connection point, and the angle being between approximately −15 degrees and +15 degrees. Thereby, overlapping of the central lines of the first and second vortices may be suppressed.

When a point at which the line segment between the point A on the first circular arc and the center of the first circular arc may cross the line segment between the point B on the second circular arc and the center of the second circular arc is defined as point F, the point F is positioned at an inner side of the profile of the open-cut portion. Thereby, a proper distance between the first and second vortices may be maintained as the center lines of the first and second vortices extend to the rear side of the blade, thereby further suppressing the overlapping.

A raised portion or rib may be provided to the pressure surface of the blade, at and around a connection point of the first and second arcs at the leading end of the profile of the open-cut portion. Thereby, the start point of the first vortex and the second vortex spinning in the opposite directions may become more apparent at the leading end of the open-cut portion.

Similarly, a raised portion or rib may be provided to the suction surface of the blade, at and around the connection point of the first and second arcs at the leading end of the profile of the open-cut portion.

Raised portions or ribs may be provided to the pressure surface and suction surface of the blade, at and around the connection point of the first and second arcs at the leading end of the profile of the open-cut portion Thereby, vortices may be smoothly created, and interference between the first vortex and the second vortex spinning in the opposite direction at the open-cut portion may be promoted, enhancing the propulsive power of the blade.

A radial cross section of the profile of the open-cut portion may have a rounded corner extending from the pressure surface of the blade toward the suction surface.

Further, a radial cross section of the profile of the open-cut portion may have a rounded corner extending from the suction surface of the blade toward the pressure surface.

The raised portion or rib may be provided to the suction surface of the blade along the profile of the open-cut portion. Thereby, interference between the first and second vortices may be uniformly intensified along the entire profile of the open-cut portion, and the propulsive power of the blade may be enhanced.

The height of the raised portion or rib may be constant as the portion or rib extends from the leading edge of the blade toward the trailing edge.

The height of the raised portion or rib may gradually increase as the raised portion or rib extends from the leading edge of the blade toward the trailing edge. Thereby, interference between the first and second vortices may be gradually intensified, and the propulsive power of the blade may be enhanced.

The height of the raised portion or rib may gradually decrease as the raised portion or rib extends from the leading edge of the blade toward the trailing edge. Thereby, mutual interference between the first vortex and the second vortex spinning in the opposite directions may be intensified immediately after the first vortex and the second vortex are produced, and the flows may follow the paths where the first and second vortices are easily interfered with each other.

According to an air conditioner employing the propeller fan of the present invention as above, the air conditioner may be efficiently operated due to enhanced air blowing power.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
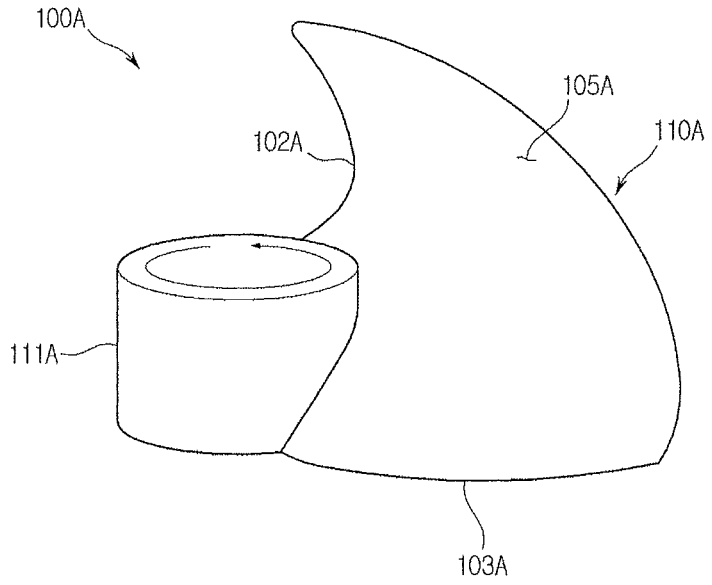
FIG. 1 is a perspective view illustrating the shape of a conventional propeller fan and inclination of the streams at the blade trailing edge portion.
Figure 1:
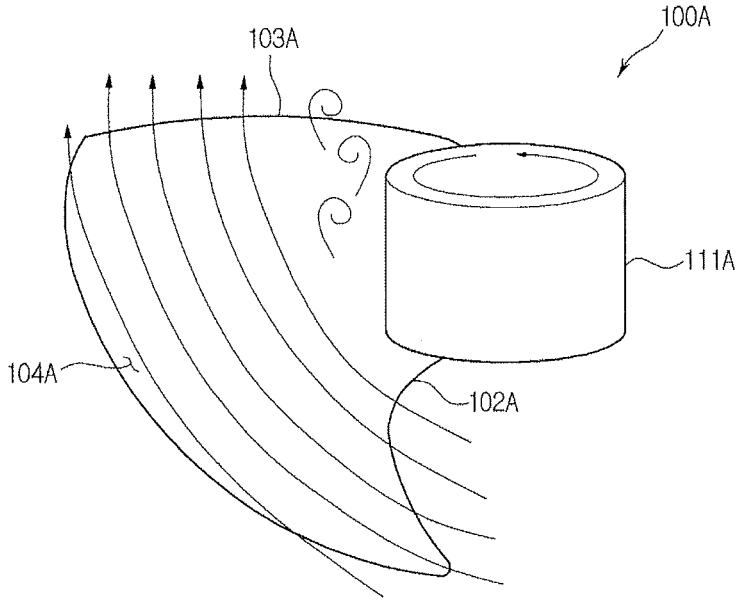
Figure 2:
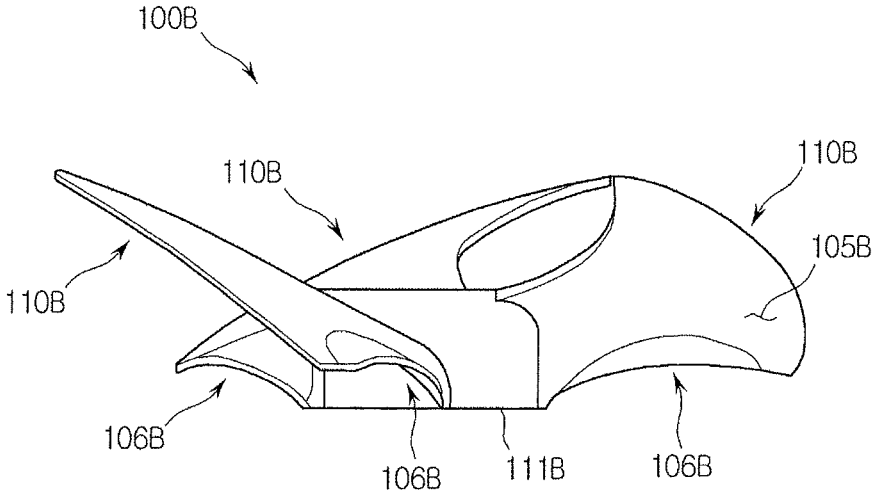
FIG. 2 is a view illustrating an example of the swollen portion provided to the blade trailing edge portion of a conventional propeller fan.

Reference will now be made in detail to the embodiments of the present invention, examples of which are illustrated in the accompanying drawings, wherein like reference numerals refer to like elements throughout.

Hereinafter, the embodiments of the present invention will be described in detail with reference to the drawings. The embodiments described below are simply illustrative and are not intended to limit the applications or the purpose of the present invention.

Hereinafter, a first embodiment of the present invention will be described with reference to the drawings.

A propeller fan 1 of the first embodiment, which is applied, for example, to an outdoor of an air conditioner, includes a plurality of blades 10 radially arranged on the outer circumferential surface of a cylindrical hub 9 and spaced a predetermined distance from each other in a circumferential direction of the hub 9. In each drawing, one of the blades 10 of the propeller fan 1 is shown as a representative example.

Figure 3:
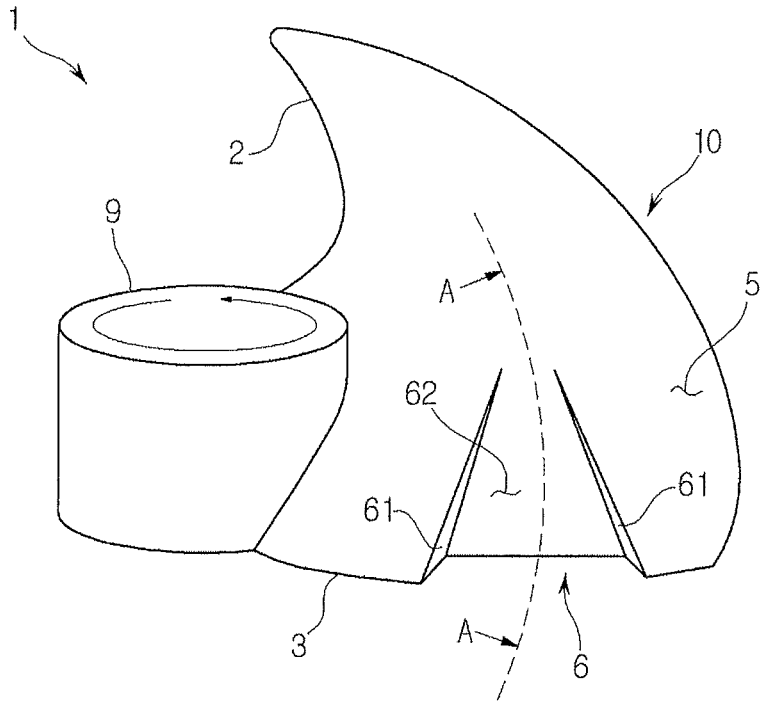
FIG. 3 is a perspective view illustrating a propeller fan according to a first embodiment of the present invention.
Figure 4:
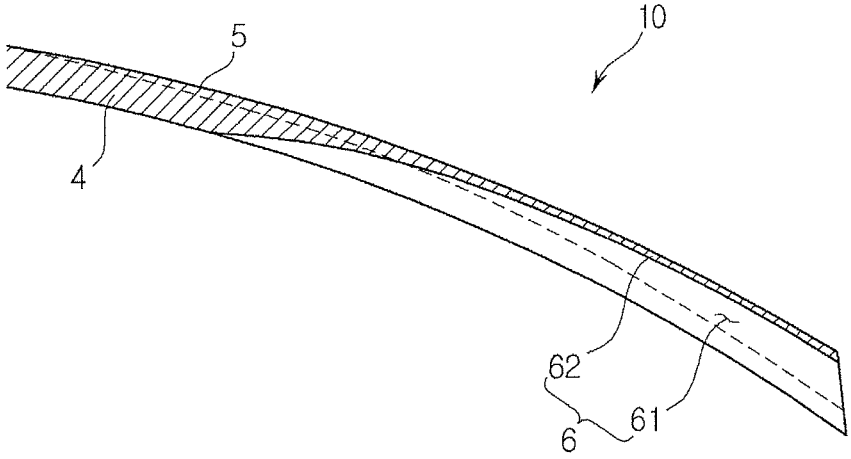
FIG. 4 is a cross-sectional view illustrating a recessed portion according to the first embodiment, taken along line A-A of FIG. 3 in the longitudinal direction of the blade chord.

FIG. 3 is a perspective view illustrating the shape of the blade 10 of the propeller fan 1 according to the first embodiment, seen from the side of the suction surface 5, and FIG. 4 shows a cross-section taken along line A-A of FIG. 3 in the longitudinal direction of the blade chord.

As shown in FIG. 3, the blade 10 is mounted on the lateral surface of the cylindrical hub 9 to form a predetermined spiral extending from one cross section of the hub 9 to the other cross section thereof. The leading edge 2 of the blade 10 extends to protrude forward with respect to the direction of rotation. In addition, the cross section of the blade 10 of FIG. 4, which is taken along line A-A of FIG. 3, forms a predetermined curve in the longitudinal direction of the chord, and the surface of the concave side of the blade 10 defines the pressure surface 4, and the surface of the convex side of the blade 10 defines the suction surface 5.

As shown in FIGS. 3 and 4, the blade 10 is provided with a recessed portion 6 formed around the center of the trailing edge 3 such that the corresponding portion of the suction surface 5 is raised and the corresponding portion of the pressure surface 4 is depressed.

Hereinafter, the shape and dimensions of the recessed portion 6 will be described with reference to FIGS. 3 to 10.

Figure 5:
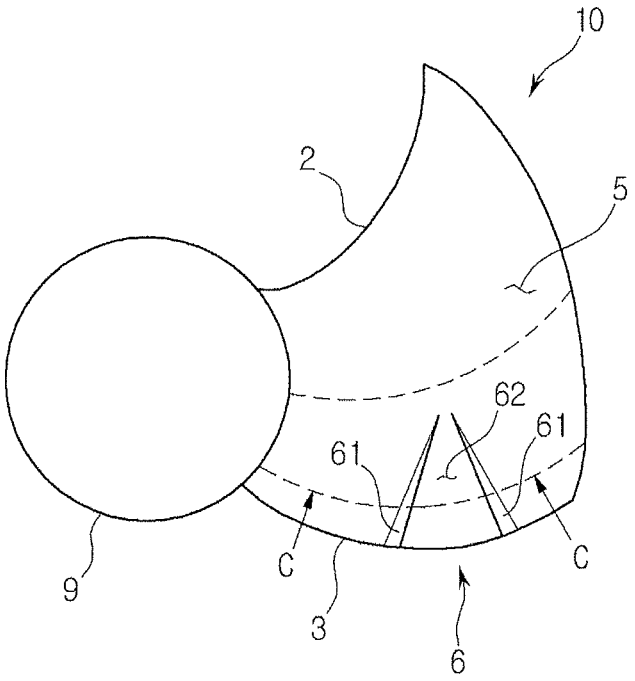
FIG. 5 is a view illustrating the suction surface seen along an axis of rotation of the fan according to the first embodiment.
Figure 6:
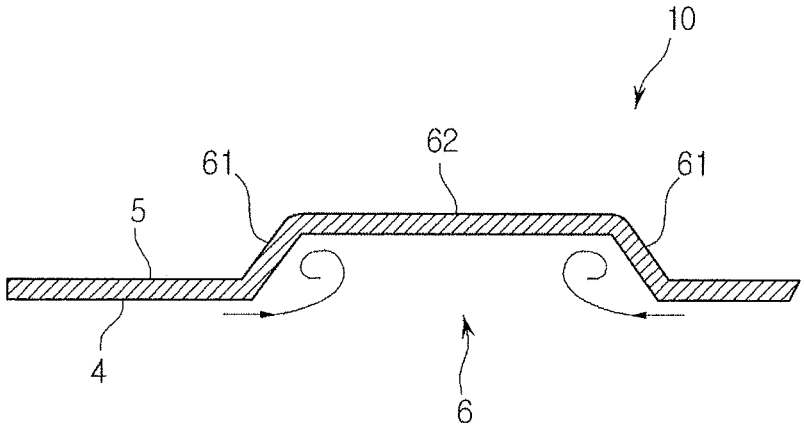
FIG. 6 is a cross-sectional view illustrating the recessed portion, taken along line C-C of FIG. 5 in a radial direction.

FIG. 6 shows a cross section of the recessed portion 6 taken along line C-C of FIG. 5, which shows the suction surface 5 of the blade 5 seen along an axis of rotation. As shown in FIG. 6, the central part of the recessed portion 6 near the trailing edge 3 is raised along the radial direction to form a raised part on the suction surface 5 and an opening on the pressure surface. As can be seen from FIG. 5, when the suction surface 5 or the pressure surface 4 is viewed along the direction in which the axis of rotation C extends, the recessed portion 6 is widened from the side of the leading edge to the trailing edge 3 in an approximately trapezoidal shape.

In addition, as can be seen from the cross section of FIG. 6 taken along the radial direction of the blade 10 including the recessed portion 6, the recessed portion 6 has a bracket shape having the bottom portion 62 on the suction surface 5. More specifically, when the cross section is seen, the recessed portion 6 is provided with a pair of lateral portions 61 raised from the suction surface 5 at a predetermined angle and facing each other, and a bottom portion 62 closing the space between the lateral portions 61 on the suction surface 5 and having a curved surface with the shape of an approximately rounded triangle. In other words, as can be seen from the cross-sectional view of FIG. 6, the curvature greatly changes at the corners of the recessed portion 6 where the pressure surface 4 or the suction surface 5 is connected with the lateral portions 61.

Furthermore, as show in FIGS. 3 and 5, the recessed portion 6 is formed in an approximately trapezoidal shape by increasing the span-wise width between the lateral portions 61 from the upstream side (the side of the leading edge 2) to the downstream side (the side of the trailing edge 3).

Figure 7:
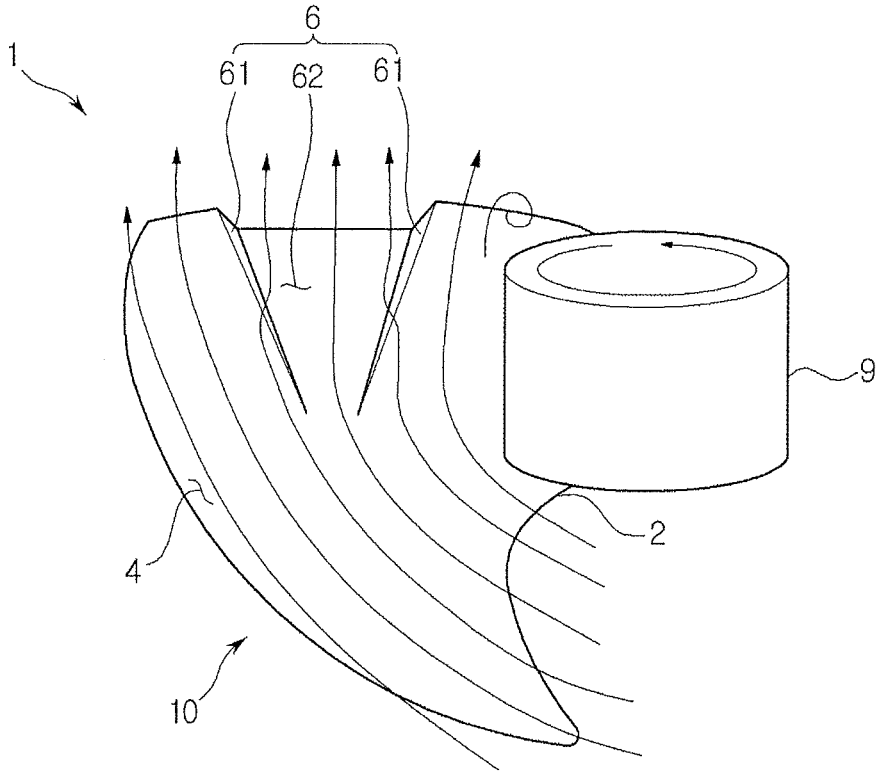
FIG. 7 is a perspective view illustrating the streams near the pressure surface according to the first embodiment.

Since the recessed portion 6 having the above shape is formed at the center of the blade trailing edge portion, the flow near the pressure surface 4 shown with streamlines in FIG. 7 are introduced into the recessed portion 6 at the blade trailing edge portion. Accordingly, when FIGS. 1 and 5 are compared, the airstream, which is usually inclined radially outward, may be caused to be uniform at the blade trailing edge portion, and the flow near the inner diameter side of the blade connected with the hub 9 may be prevented from being disturbed or separated.

Hereinafter, the proper position and the proper range of dimensions of the recessed portion 6 which may achieve uniform airstream will be described.

Figure 8:
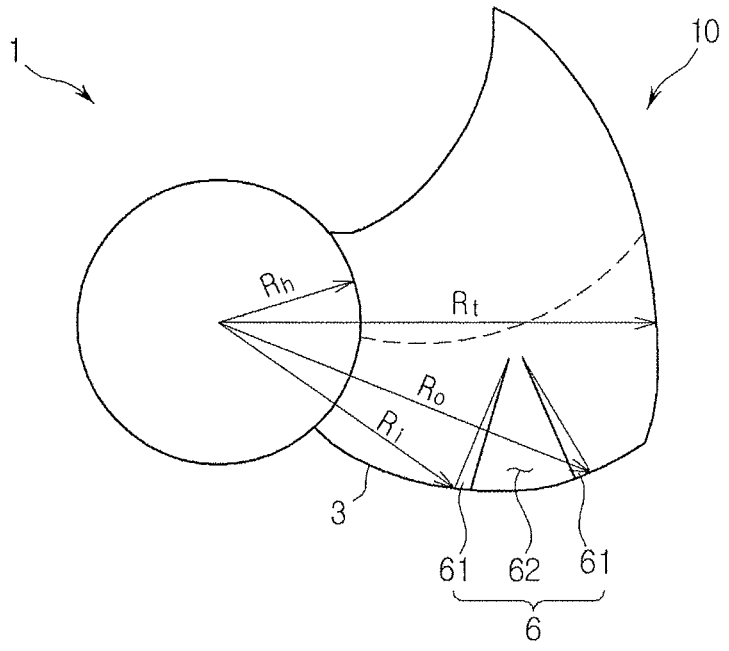
FIG. 8 is a view illustrating parameters representing the position of the recessed portion according to the first embodiment.

First, the position of the recessed portion 6 at the blade trailing edge portion will be described. As shown in FIG. 8, when the outer diameter of the blade 10 is defined as Rt, the inner diameter of the blade 10 as Rh, the radius from the center to the end of one of the lateral portions 61 positioned at an inner diameter side and arranged at the trailing edge 3 of the blade 10 as Ri, and the radius from the center to the end of the other one of the lateral portions 61 positioned at an outer diameter side and arranged at the trailing edge 3 of the blade 10 as Ro, the recessed portion 6 is formed around the axis of rotation of the fan C such that $Ri=Rh+\alpha(Rt-Rh)$ and $Ro=Rh+\beta(Rt-Rh)$, where $0.2\leq\alpha\leq0.6$, $0.6\leq\beta\leq0.9$.

Figure 9:
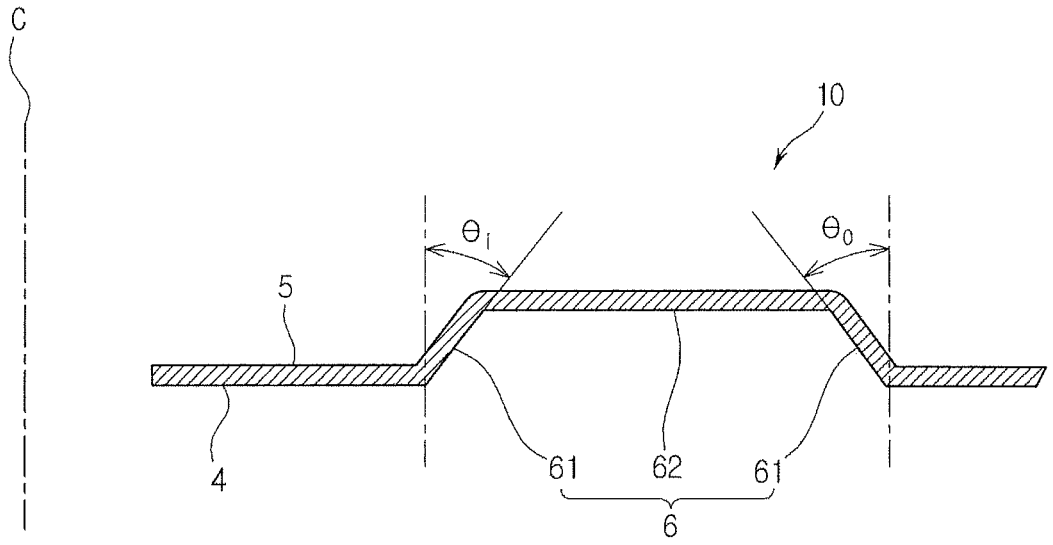
FIG. 9 is a view illustrating inclination angles of the lateral surfaces according to the first embodiment.

Next, raising the recessed portion 6, i.e., elevation of the lateral portions 61 with respect to the suction surface 5 will be described with reference to FIG. 9. As shown in FIG. 9, when the inclination angle of one of the lateral portions 61 of the recessed portion 6 positioned at the inner diameter side with respect to the axis of rotation of the fan C is $\theta i$, and the inclination angle of the other one of the lateral portions 61 positioned at an outer diameter side respect to the axis of rotation of the fan C is $\theta o$, $5°\leq\theta i\leq60°$, $5°\leq\theta o\leq60°$, and $\theta i\geq\theta o$. In other words, on the pressure surface 4, the inclination of the other one of the lateral portions 61 farther from the axis of rotation of the fan C is steeper than that of the one of the lateral portions 61 closer to the axis of rotation C such that the flow at the outer diameter side is strongly drawn into the recessed portion 6. Thereby, sizes of a pair of longitudinal vortices formed at the lateral portions 61 may become equal, and therefore the pressure efficiency may be more easily improved.

Figure 10:
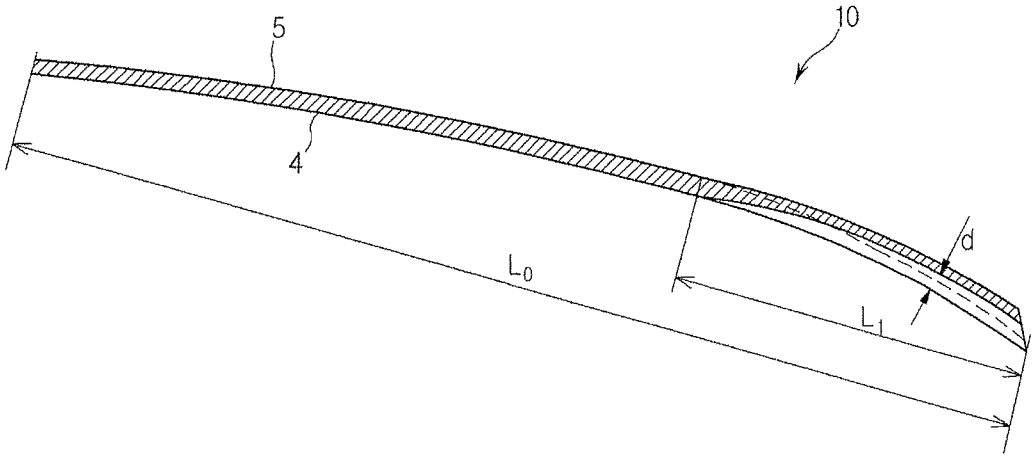
FIG. 10 is a view illustrating the position and depth of the recessed portion on the blade according to the first embodiment.
Figure 11:
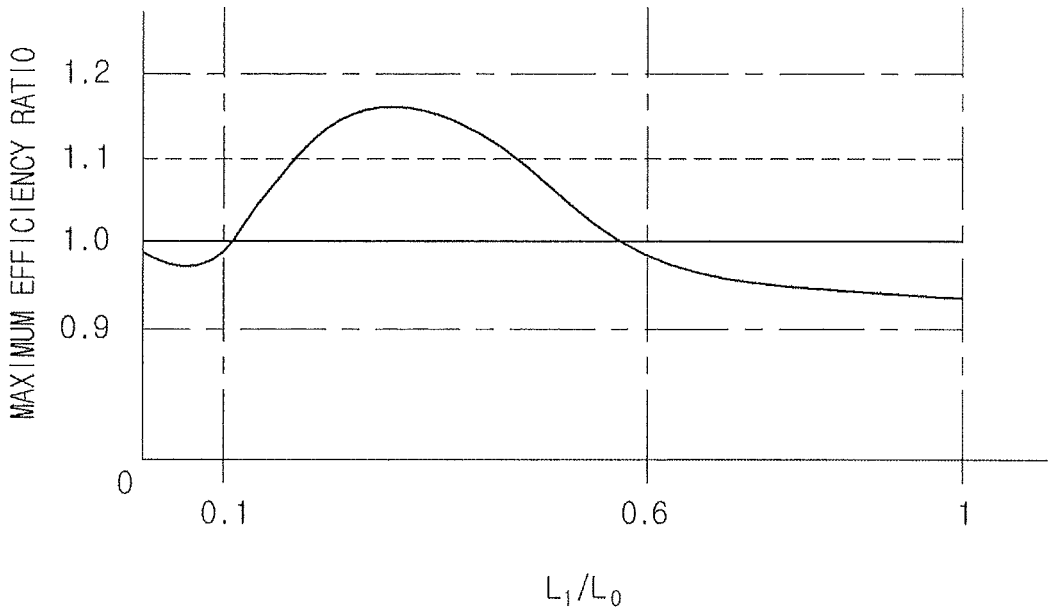
FIG. 11 is a graph depicting the relationship between a ratio of the length of the recessed portion to the length of the blade chord and the maximum efficiency ratio according to the first embodiment.

Next, the size of the recessed portion 6 in the longitudinal direction of the chord of the blade 10 and the depth of the recessed portion 6 will be described. As shown in FIG. 10, in the cross section taken along line A-A of FIG. 3 extending in the circumferential direction at the radius where the one of the ends of the recessed portion 6 close to the leading edge 2 is positioned, the length of the recessed portion 6 from the trailing edge 3 to the one end of the recessed portion 6 close to the leading edge 2, L1, is set to be approximately 10% to 60% of the length of the chord L0. More specifically, when the ratio of the length of the recessed portion 6, L1, to the length of the chord L0 is between 0.1 and 0.6, as shown in FIG. 11, the maximum value of the maximum efficiency ratio is obtained. L1 may be set to be approximately 20% to 45% of L0. More specifically, when L1 is set to be about 30% of L0, the maximum value of the maximum efficiency ratio may be obtained.

Figure 12:
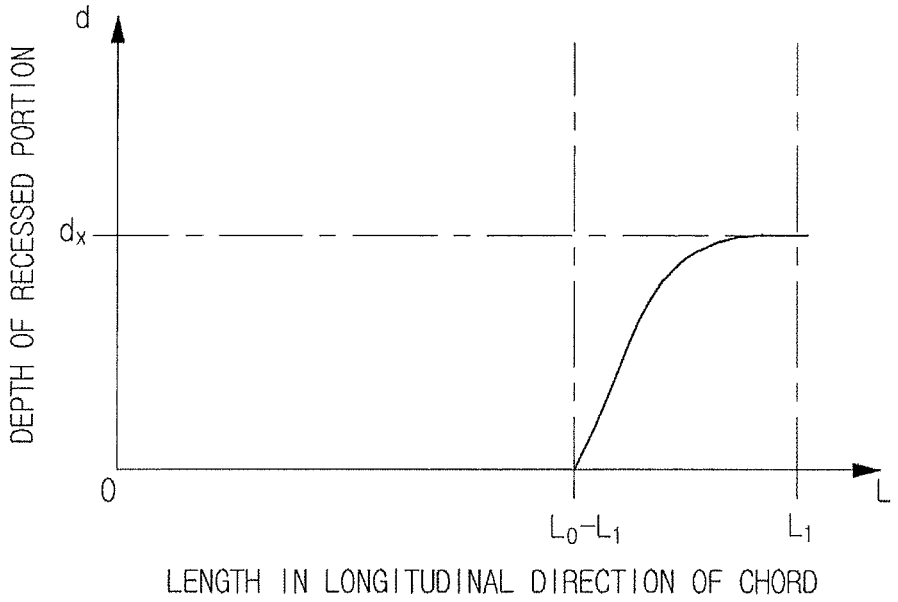
FIG. 12 is a graph depicting a depth profile of the recessed portion according to the first embodiment.

In addition, in the cross section extending in the circumferential direction at the radius where the one end of the recessed portion 6 close to the leading edge 2 is positioned, the depth d of the recessed portion 6 to the suction surface 5 gradually increases as the recessed portion 6 extends from the upstream to the downstream. Near the blade trailing edge 3, the depth d of the recessed portion 6 becomes almost constant as a predetermined depth dx. In addition, the predetermined depth dx is set to be approximately 2% to 10% of the length of the chord L0. More specifically, as shown in FIG. 12, the depth d of the recessed portion 6 drastically changes near the upstream of the recessed portion, and the rate of change of the depth d is low at the blade trailing edge portion.

As described above, by defining the size of the recessed portion 6 of the blade 10, balance may be kept between the original function of the blade 10 and the function of correcting the flow, thereby improving the pressure efficiency. In addition, when the depth d of the recessed portion 6 is formed to have a value as above, the flow may be securely drawn into the recessed portion 6 by the step formed between the recessed portion 6 and the pressure surface 4 around the recessed portion 6. Accordingly, the centrifugal flow may be suppressed, and thus the pressure efficiency may be improved.

Next, a propeller fan 1 according to a second embodiment will be described with reference to FIGS. 13 to 16.

Figure 13:
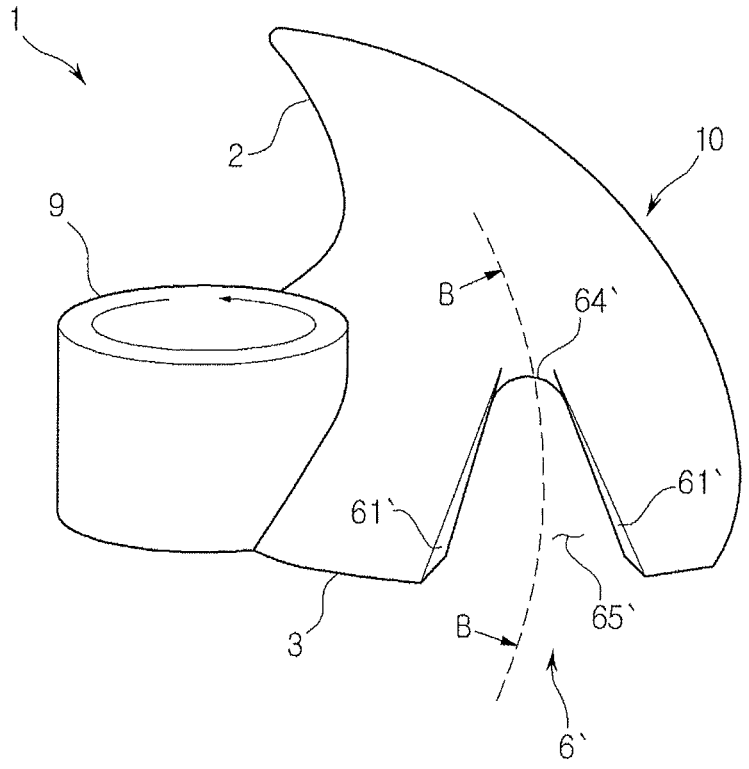
FIG. 13 is a perspective view illustrating a propeller fan according to a second embodiment of the present invention.

In the second embodiment, as shown in FIG. 13, the recessed portion 6 is open not only on the pressure surface 4 but also on the suction surface 5, and thus a recessed portion 6' is formed only by lateral portions 61', in contrast with the first embodiment. In other words, while the first embodiment is provided with the bottom portion 62, the recessed portion 6' of the second embodiment is provided with an opening 65' by cutting off the bottom portion 62.

Hereinafter, a detailed description will be given of the shape of the blade 10 of the second embodiment.

Figure 14:
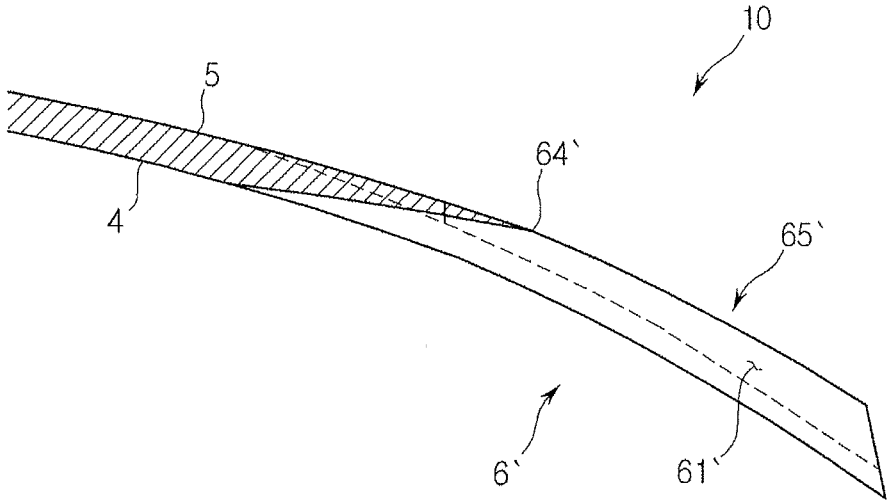
FIG. 14 is a view illustrating is a cross-sectional view illustrating a recessed portion according to the second embodiment, taken along line B-B of FIG. 13 in the longitudinal direction of the blade chord.
Figure 15:
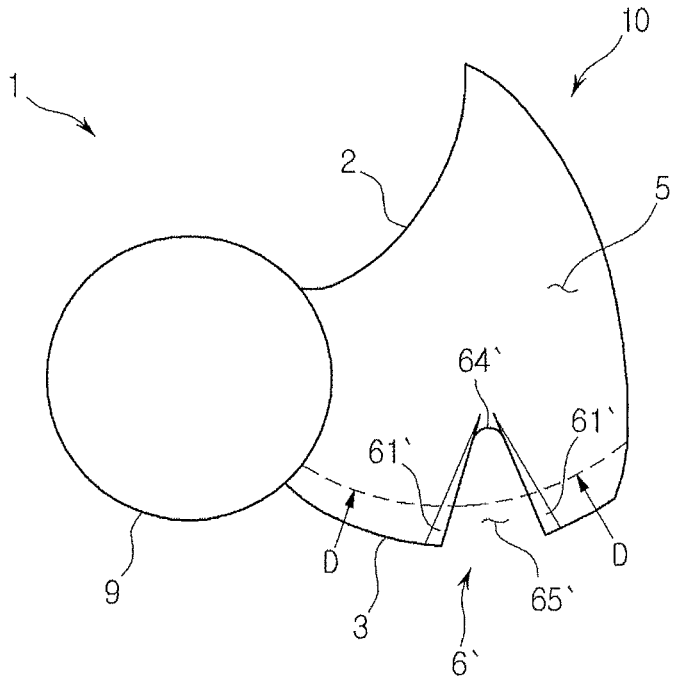
FIG. 15 is a view illustrating the suction surface seen along an axis of rotation of the fan according to the second embodiment.

As shown in FIGS. 13 and 15, the rounded triangular bottom portion 62 of the recessed portion 6' is cut off. As illustrated in FIG. 14, showing a cross section of the recessed portion 6' taken along line B-B of FIG. 13, and FIG. 15, showing a cross section of the recessed portion 6' taken along line D-D of FIG. 13, the recessed portion 6' is configured with only two lateral portions 61' raised from the suction surface 5.

Figure 16:
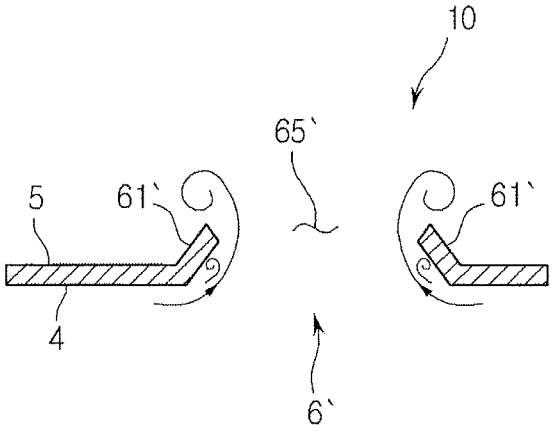
FIG. 16 is a cross-sectional view illustrating the recessed portion, taken along line D-D of FIG. 15 in the radial direction.

That is, referring to FIG. 14, the depth of the upstream end of the recessed portion 6' is the same as in the first embodiment shown in FIG. 4, while the recessed portion 6' has no this plate at the downstream side in contrast with the first embodiment. In addition, as shown in FIG. 16, when the flow near the pressure surface 4 is drawn to the recessed portion 6', the streams pass along the lateral portions 61' and flow out to the suction surface 5, thereby creating longitudinal vortices on the suction surface 5. Due to the longitudinal vortices on the suction surface 5, the flow near the suction surface 5 is prevented from separating. Therefore, the pressure efficiency may be further improved.

In addition, the lateral portions 61' are connected to each other by the rounded upstream end portion 64' on the suction surface 5, the radius of curvature of the upstream end portion 64' is set to be approximately equal to or greater than the thickness of the blade 10 and equal to or less than five times the thickness of the blade 10. Thereby, concentration of stress due to centrifugal force may be prevented from being concentrated at the upstream end of the opening provided to the blade 10 such that the blade 10 is easily damaged. In other words, even though the bottom portion 62 of the recessed portion 6' is cut off, strength of the blade 10 may be prevented from being degraded and the pressure efficiency may be improved.

Next, variations of the second embodiment will be described with reference to FIGS. 17 to 19.

Figure 17:
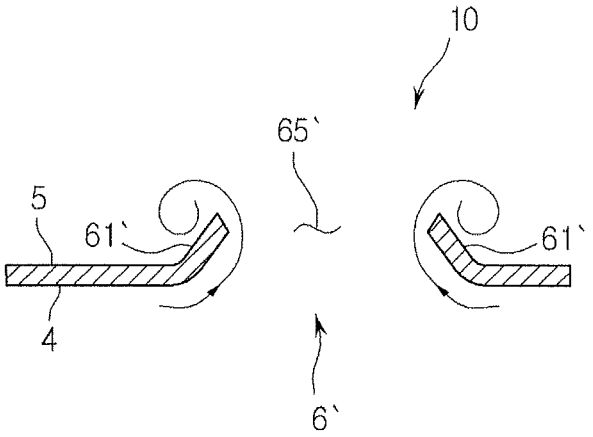
FIG. 17 is a cross-sectional view illustrating the cross section of a recessed portion according to a variation of the second embodiment, taken along a radial direction.

As shown in FIG. 17, each of the lateral portions 61' may be connected to the pressure surface 4 in a rounded fashion. In other words, by connecting the lateral portions 61' to the pressure surface 4 such that round corners, rather than a sharp corners shown in the FIG. 16, are formed therebetween as shown in FIG. 17, loss or disturbance of flow along the lateral portions 61' on the suction surface 5 may be reduced and thus the pressure efficiency may be further improved.

Figure 18:
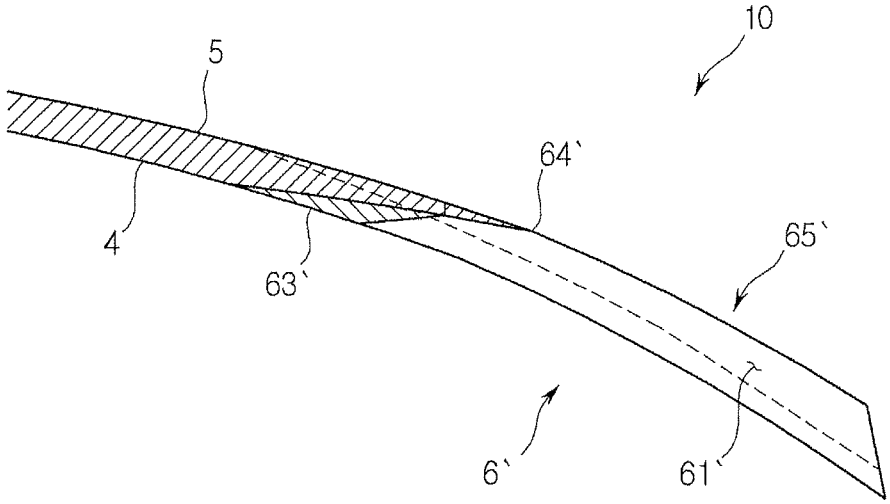
FIG. 18 is a cross-sectional view illustrating the cross section of the recessed portion according to the variation of the second embodiment, taken along the longitudinal direction of the blade chord.
Figure 19:
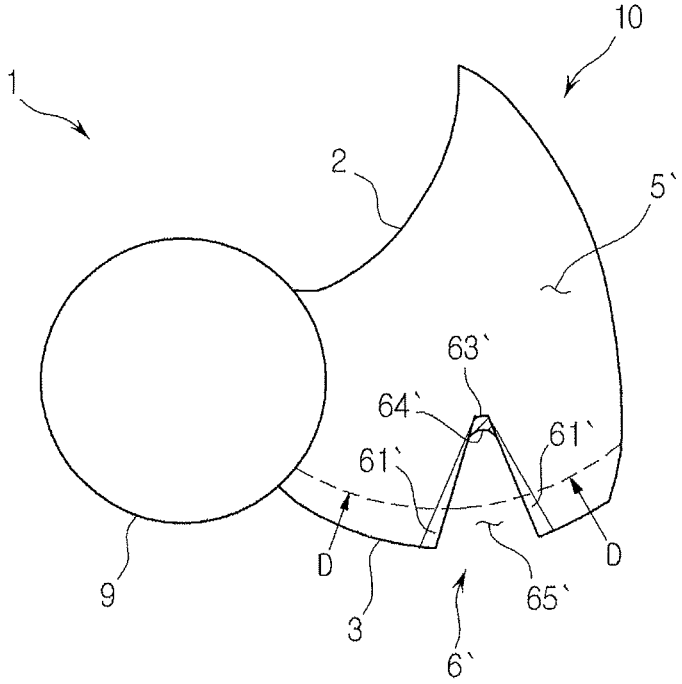
FIG. 19 is a view illustrating the suction surface seen along an axis of rotation of the fan according to the variation of the second embodiment.

In addition, as shown in FIGS. 18 and 19, the recessed portion 6' may be provided with a filling portion 63' formed by filling the gap between the upstream ends of the lateral portions 61' on the side of the pressure surface 4. The filling portion 63' may form the same curved surface with the adjacent pressure surface 4. Referring to FIG. 18, a larger inner space of the leading end portion of the recessed portion 6' is filled due to the filling portion 63' than in FIG. 14. Thereby, stress concentrated at the upstream end of the opening provided to the blade 10' due to centrifugal force may be further relieved, and the blade 10' may be prevented from being easily damaged.

Figure 20:
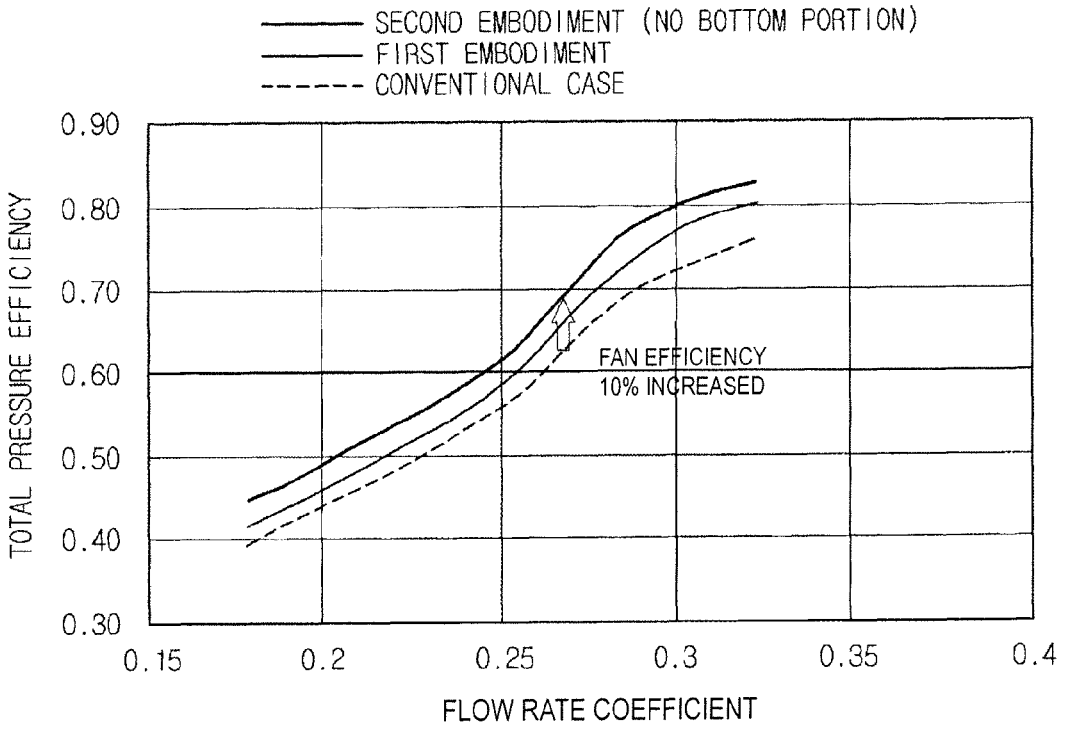
FIG. 20 is a graph depicting the fan efficiencies in the first embodiment, the second embodiment, and the conventional case in a comparative manner.

FIG. 20 is a graph depicting the pressure efficiencies of the propeller fans 1 of the first embodiment, the second embodiment, and the conventional case in a comparative manner.

As shown in FIG. 20, the propeller fan 1 according to the first embodiment and the second embodiment may create approximately uniform flow at the outlet of the blade 10 due to the flow drawing effect of the recessed portion 6, and therefore may improve the pressure efficiency, compared to the conventional propeller fan 1. In addition, when a open-cut portion is formed on the blade 10 by eliminating the bottom surface of the recessed portion 6' as in the second embodiment, the pressure efficiency may be most improved, and may be increased by 10%, compared to the conventional case.

Hereinafter, other embodiments will be described.

Each of the embodiments provides a propeller fan applied to an air conditioner, but the propeller fan may also serve other purposes. In addition, whether to retain or eliminate the bottom surface of the recessed portion may be properly determined, considering balance between the desired pressure efficiency and a demanded strength of the blade.

Hereinafter, a third embodiment will be described with reference to the drawings.

The propeller fan 1 according to the third embodiment, which is applied, for example, to an outdoor of an air conditioner, includes a plurality of blades 10 radially arranged on the outer circumferential surface of a cylindrical hub 9 and spaced a predetermined distance from each other in a circumferential direction of the hub 9. In each drawing, one of the blades 10 of the propeller fan 1 is shown as a representative example.

Figure 21:
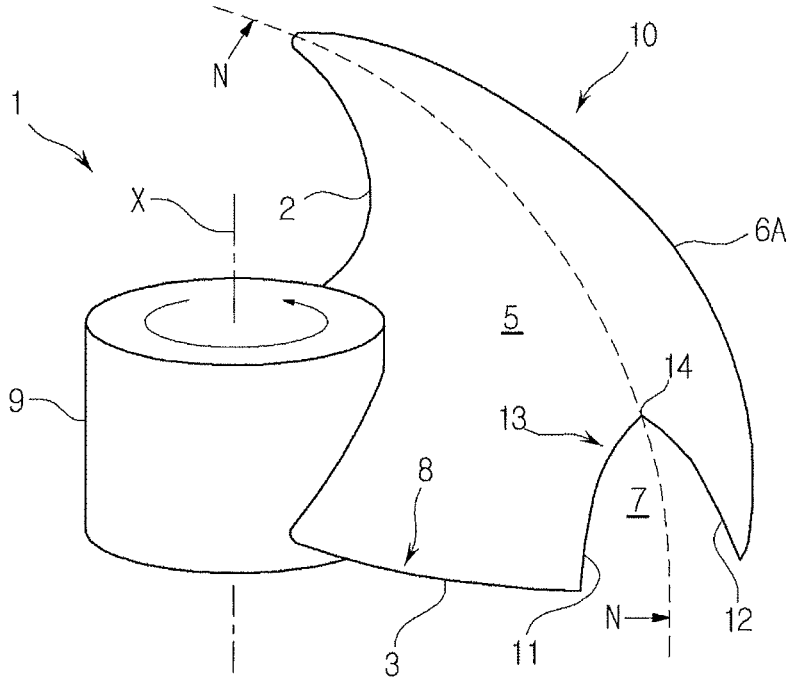
FIG. 21 is a perspective view illustrating a blade of a propeller fan according to a third embodiment of the present invention, seen from the side of the suction surface.
Figure 22:
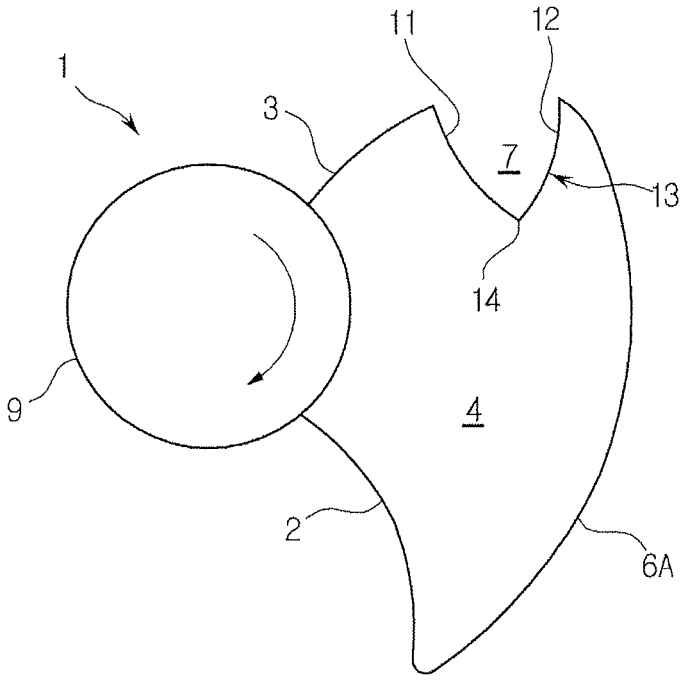
FIG. 22 is a view illustrating the blade of the propeller fan according to the third embodiment, seen from the side of the pressure surface along the axis of rotation of the fan.

The shape of the blade 10 of the propeller fan 1 according to the third embodiment will be described with reference to FIG. 21 showing the perspective view of the blade 10 seen from the side of the suction surface 5, and FIG. 22 showing the pressure surface 4 seen along the axis of rotation of the fan X.

As shown in FIG. 21, the blade 10 is mounted on the lateral surface of the cylindrical hub 9 to form a predetermined spiral extending from one cross section of the hub 9 to the other cross section thereof. The leading edge 2 of the blade 10 extends to protrude forward with respect to the direction of rotation. In addition, the cross section of the blade 10 forms a predetermined curve in the longitudinal direction of the chord, and the surface of the concave side of the blade 10 defines the pressure surface 4, and the surface of the convex side of the blade 10 defines the suction surface 5.

Figure 23:
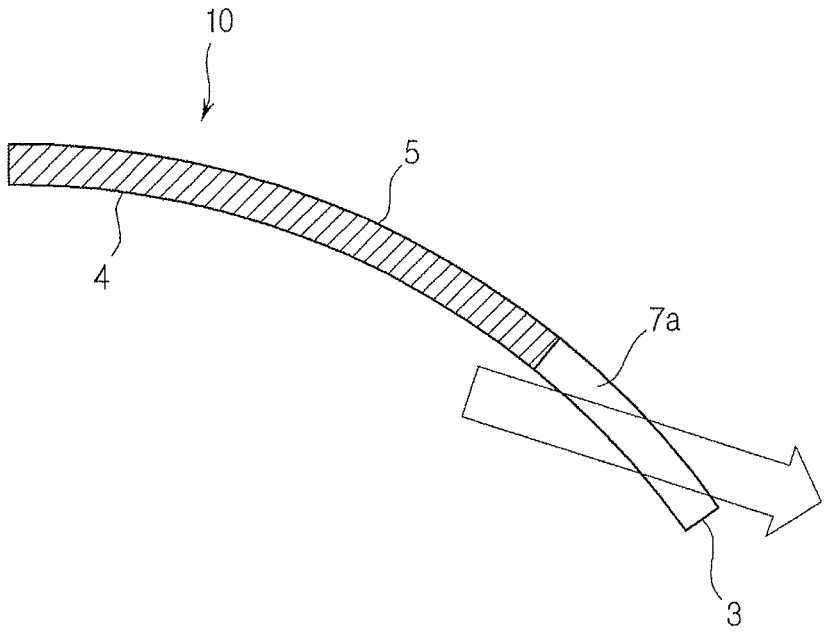
FIG. 23 is a cross-sectional view illustrating an open-cut portion according to the third embodiment, taken along line N-N of FIG. 21 in the longitudinal direction of the chord.
Figure 24:
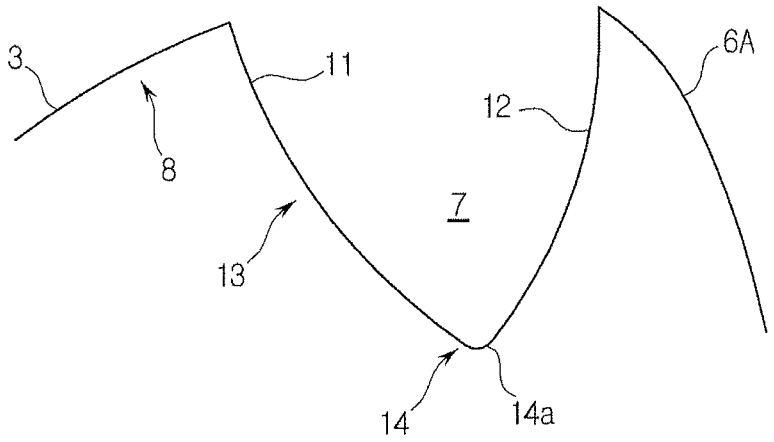
FIG. 24 is an enlarged view illustrating a concave portion having a minimum arc according to the third embodiment, seen from the side of the pressure surface along the axis of rotation of the fan.

As shown in FIGS. 21 and 22, the blade 10 is provided with an open-cut portion 7 formed near the outer circumferential edge 6A by cutting off a portion of the blade 10 extending a certain length from the trailing edge 3 toward the front side of the blade 10. Each blade 10 is provided with one open-cut portion 7. As shown in FIG. 23, the open-cut portion 7 is provided with a sidewall 7*a* having the same thickness as that of the blade 10. Meanwhile a plurality of open-cut portions 7 may be provided depending on the size of the blade 10. However, in the case that a plurality of open-cut portions 7 is provided, vortices created between the open-cut portions 7 may lower the speed of outflow, lowering improvement of the propulsive power of the blade 10. Therefore, it is not needed to provide more than one open-cut portions 7.

Hereinafter, the shape and dimensions of the open-cut portion 7 will be described with reference to FIGS. 21 to 30.

The open-cut portion 7 has, as shown in FIG. 22 illustrating the pressure surface 4 of the blade 10 along the axis of rotation of the fan X, a profile 13 formed by a first arc 11 arranged close to the outer circumferential edge 6A of the blade beyond the center of the trailing edge portion 8 in the radial direction and swollen toward the inner circumference of the blade 10, and a second arc 12 swollen toward the outer circumference of the blade 10. In the profile 13, the distal end of the first arc 11 with respect to the trailing edge portion 8 is connected with the distal end of the second arc 12 with respect to the trailing edge portion 8. When the first arc 11 and the second arc 12 are connected to each other by connection of the distal ends thereof, one end of the first arc 11 meets one end of the second arc 12 at one point (connection point) form an angle less than 180 degrees at the connection point. Accordingly, one arc is not formed by connecting the first arc 11 with the second arc 12. Rather, an angle is formed between the first arc 11 and the second arc 12 at the connection point as the discontinuous first arc 11 and second arc 12 are connected to each other. Therefore, the open-cut portion 7 is provided with the profile 13 formed by two arcs forming a sharp leading end 14.

In addition, when the open-cut portion 7 is viewed in another aspect, the leading end 14 of the open-cut portion 7 is formed by connection between the first arc 11 and the second arc 12 such that a tangent line near one end of the first arc 11 and a tangent line near one end of the second arc 12 may cross each other at an acute angle, i.e., an angle less than 90 degrees. The leading end 14 may be formed to be sharp by the first and second arcs 11 and 12 meeting each other substantially at an acute angle as above. In a microscopic point of view, the leading end 14 may not necessarily have an angled shape formed by crossing of lines. It may be formed in a predetermined circular shape depending on the dimensions of the smallest machining tool for cutting of a mold. That is, in the case that the propeller fan 1 is formed of, for example, a synthetic resin, the leading end 14 of the open-cut portion 7 may have limitations in manufacturing of the propeller fan 1. That is, the leading end 14 may be formed to have a circular shape to allow removal of the molded propeller fan from the mold. Particularly, referring to 24, which shows an enlarged view of the concave portion of the open-cut portion 7 seen along the axis of rotation of the fan X, the leading end 14 of the open-cut portion 7 may be formed by interposing, for example, a minute arc 14*a* having a radius of 5 mm between the ends of the first arc 11 and the second arc 12 which configure the profile 13 of the open-cut portion 7.

Figure 25:
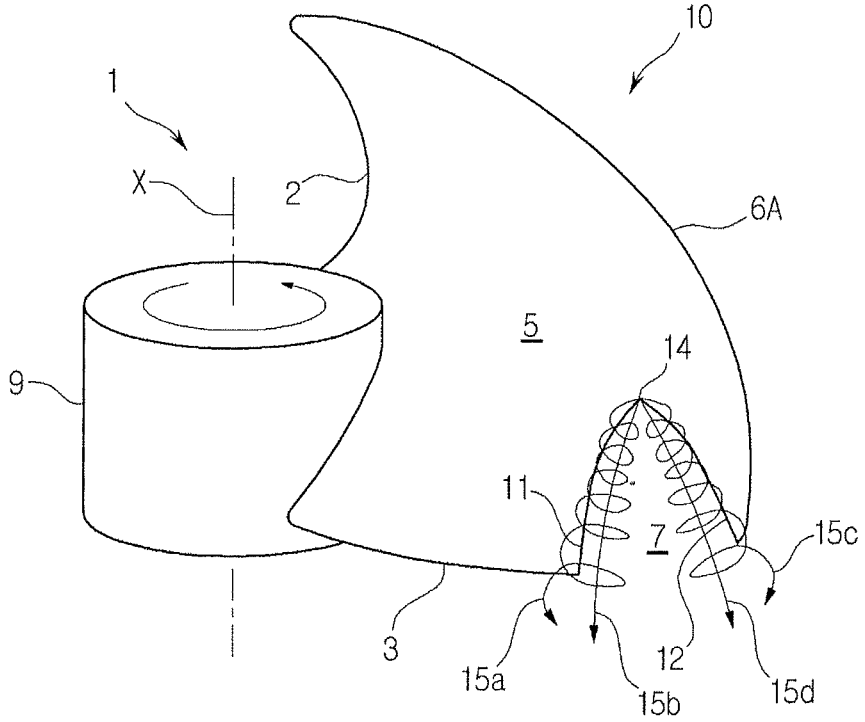
FIG. 25 is a perspective view illustrating development of vortices at the open-cut portion according to the third embodiment, which is seen from the side of the blade suction surface.

In the case that the trailing edge portion 8 of the blade 10 is provided with the profile 13 of the open-cut portion 7 with a sharp leading end 14, including the minute arc 14*a* interposed between the ends of the first arc 11 and the second arc 12 which connect the first arc 11 and the second arc 12 to each other, a first vortex 15*a* and a second vortex 15*c* starting from the leading end 14 of the open-cut portion 7 and spinning from the pressure surface 4 toward the suction surface 5 in the opposite directions are uniformly created, as shown in FIG. 25. As the first and second vortices 15*a* and 15*c* interfere with each other, the propulsive power of the blade 10 is enhanced. Thereby, degradation of the air blowing performance according to decrease of the blade area may be suppressed.

Figure 26:
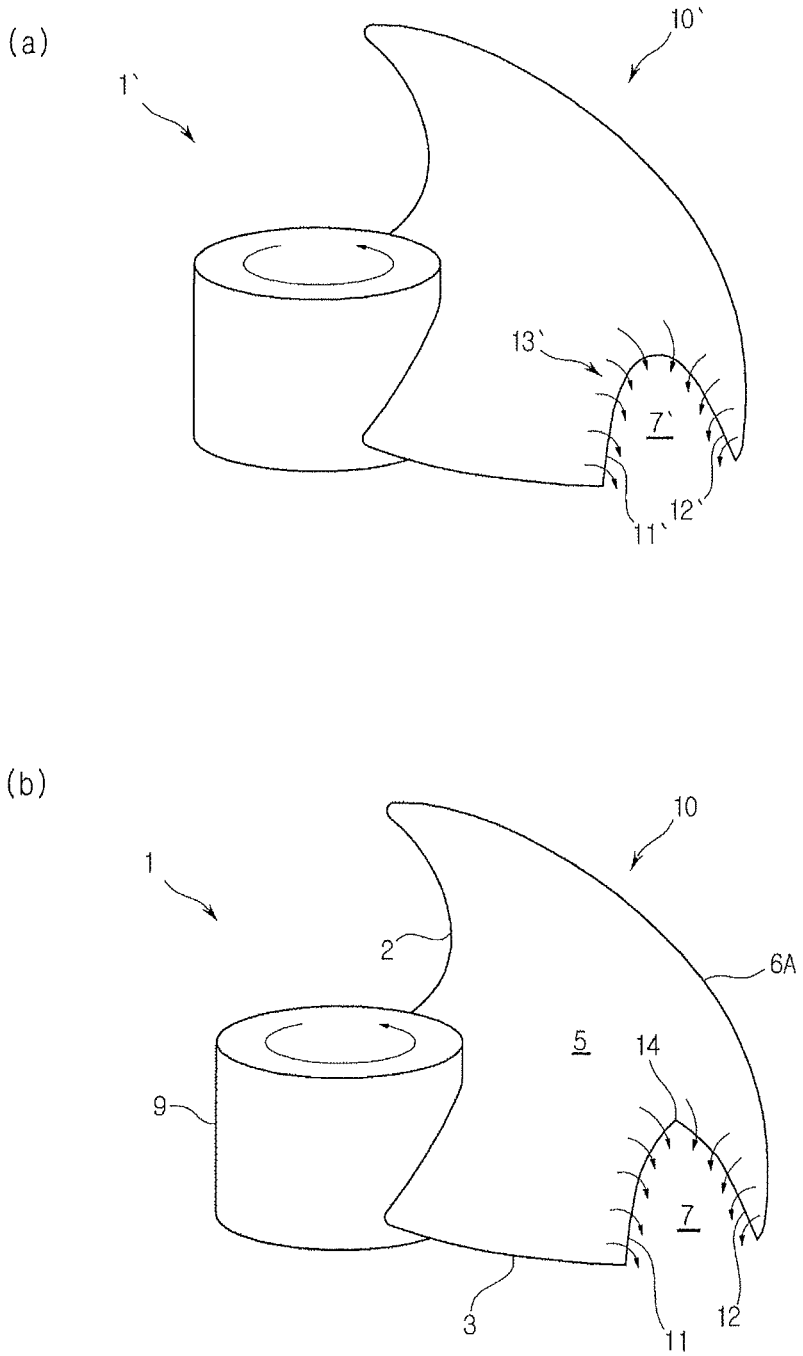
FIG. 26 is a perspective view illustrating development of vortices at the open-cut portion according to the third embodiment and an example of comparison, which are seen from the side of the blade suction surface.

Meanwhile, the open-cut portion 7' having two arcs 11' and 12' smoothly connected to each other, as exemplarily shown in FIG. 26(*a*) to compare fan efficiencies, has a shape different from that of the open-cut portion 7 having an interposed minute arc 14*a* forming the leading end 14. In the case of the propeller fan 1' having the open-cut portion 7', the profile 13' of the open-cut portion 7' does not have an apparently sharp leading end, and thus the airflows at the leading end (the airflow indicated with arrows) are not separated, but the airflows developing at respective arcs 11' and 12' are mixed with each other. Accordingly, uniform vortices are not created, and thus the propulsive power of the blade 10' may not be enhanced.

In the case of the propeller fan 1 of the first embodiment as shown in FIG. 26(*b*), the leading end 14 of the open-cut portion 7 has a clear boundary between the first arc 11 and the second arc 12, the airflows are separated at the leading end 14, uniform vortices are created along both the first arc 11 and the second arc 12, and therefore the propulsive power of the blade 10 may be enhanced.

As can be seen from the above, the ends of the first arc 11 and the second arc 12 meeting at the leading end 14 do not smoothly extend in the opposite direction. Rather, the ends of the first arc 11 and the second arc 12 directed in the directions other than the directions opposite to each other are connected to protrude outward of the open-cut portion 7. In other words, the leading end 14 is provided with a sharply curved linear profile by connection of one end of the first arc 11 with one end of the second arc 12. Accordingly, even in the case that the minute arc 14*a* is provided, the sharply curved leading end 14 may be configured if the tangent lines of the first arc 11 and the second arc 12 near the minute arc 14*a* do not coincide with each other and the difference between the inclination angles thereof is equal to or greater than a predetermined value, such that the overall profile 13 of the open-cut portion 7 has a unsmooth, sharply curved linear shape protruding from the open-cut portion 7.

Next, the position and range of size of the open-cut portion 7 proper for enhancement of the propulsive power of the blade 10 will be described.

Figure 27:
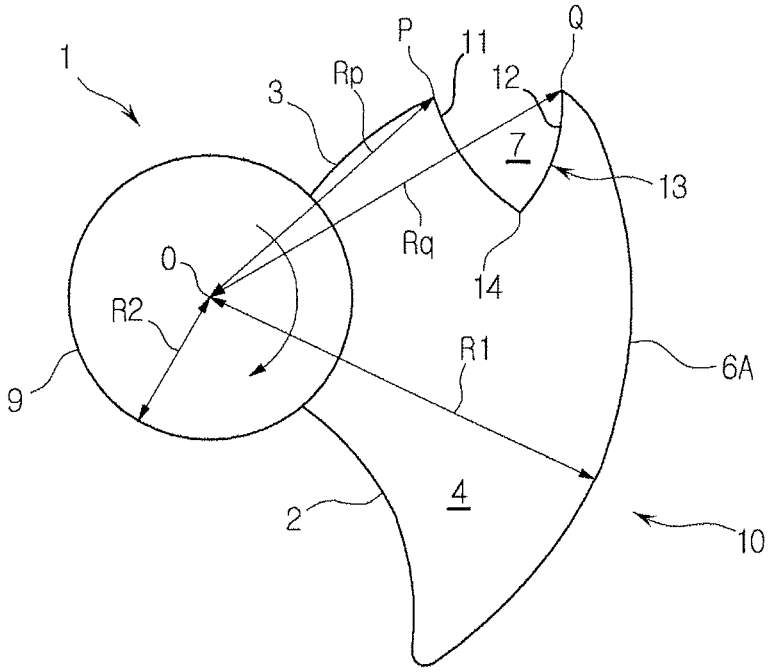
FIG. 27 is a view illustrating the dimension of each part according to the third embodiment, seen from the side of the pressure surface along the rotational axis of the blade.

First, disposing the open-cut portion 7 at the trailing edge portion 8 will be described. Referring to FIG. 27 showing the pressure surface 4 of the blade 10 viewed along the axis of rotation of the fan X, when the center of rotation of the propeller fan 1, i.e., the point passing through the axis of rotation of the fan X is defined as O, the radius of the blade 10 as R1, the radius of the hub 9 as R2, two connection points at which the trailing edge 3 of the blade 10 meets the profile 13 of the open-cut portion 7 as P (positioned at the inner side close to the hub 9 in the radial direction of the fan) and Q (positioned at the outer side in the radial direction of the fan), the length of line segment OP connecting the center of rotation O and point P as Rp, and the length of line segment OQ connecting the center of rotation O and point Q as Rq, the first arc 11 and the second arc 12 forming the profile 13 of the open-cut portion 7 are set with a relationship represented by the following equation.

$$0.35(R1-R2)\leq(Rp-R2)<(Rq-R2)\leq(R1-R2)$$

Figure 28:
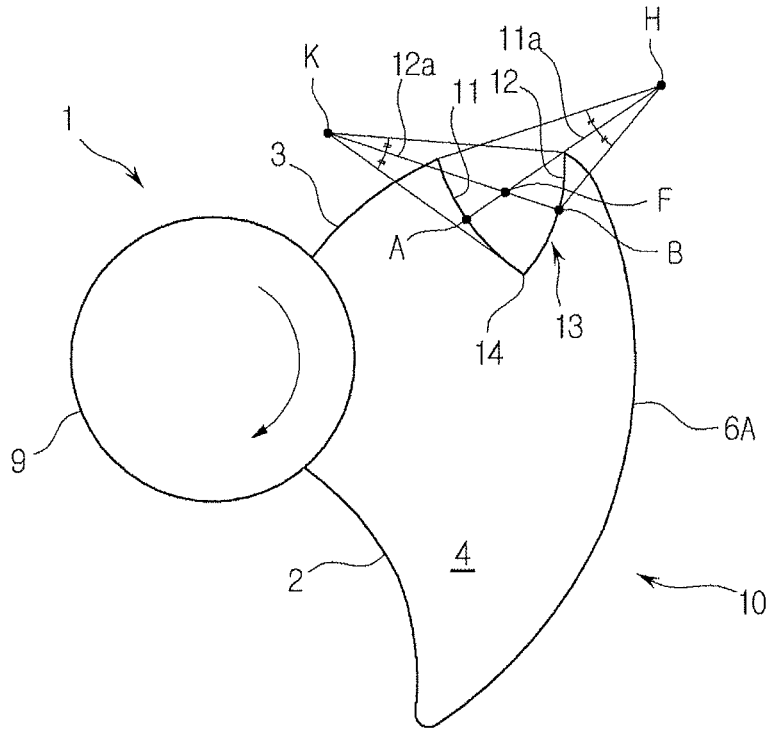
FIG. 28 is a view illustrating the conditions of the arc specifying the shape of the open-cut portion according to the third embodiment, seen from the side of the pressure surface along the axis of rotation of the fan.

Referring to FIG. 28 illustrating the pressure surface 4 of the blade 10 viewed along the axis of rotation of the fan X, in the dimensional relationship, the line segment 11*a* between point A dividing the first arc 11 into two equal parts and the center point H of the first arc 11 crosses the line segment 12*a* between point B dividing the second arc 12 into two equal parts and the center point K of the second arc 12. That is, by setting the sizes of the first and second arcs 11 and 12 such that the line segment 11*a* and the line segment 12*a* cross each other, the open-cut portion 7 may be prevented from being excessively widened at the rear side of the blade 10, which occurs when the line segment 11*a* and the line segment 12*a* do not cross each other. In this case, the point of intersection F of the line segment 11*a* and the line segment 12*a* may be at the inner side of the profile 13 of the open-cut portion 7 shown in FIG. 28, or may be at the outer side of the open-cut portion 7. The point of intersection F of the line segment 11*a* and the line segment 12*a* will be more specifically described below.

Figure 29:
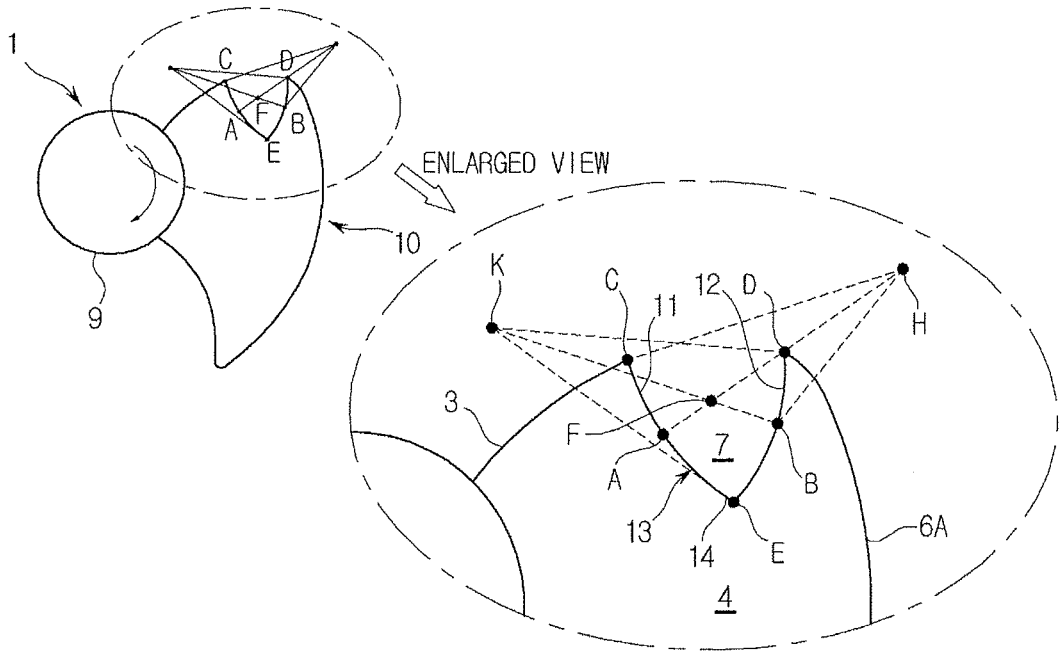
FIG. 29 is a view illustrating the conditions of the arc specifying the shape of the open-cut portion according to the third embodiment, seen from the side of the pressure surface along the axis of rotation of the fan.

Referring to FIG. 29 showing the pressure surface 4 of the blade 10 viewed along the axis of rotation of the fan X, when the point dividing the first arc 11 into two equal parts as A, the point dividing the second arc 12 into two equal parts as B, two connection points at which the trailing edge 3 of the blade 10 meets the profile 13 of the open-cut portion 7 as point C (positioned at the inner side in the radial direction of the fan) and point D (positioned at the outer side in the radial direction of the fan), and the connection point of the arcs at the leading end 14 of the profile 13 of the open-cut portion 7 as E, the first arc 11 and the second arc 12 are set such that line segment AH between point A and the center point H of arc CAE, the first arc 11, and line segment BK between point B and the center point K of arc DBE, the second arc 12 cross each other. In this case, the first arc 11 and the second arc 12 are set such that the point of intersection F of line segment AH and line segment BK is positioned in front of line segment CD in the direction of rotation, i.e., at the inner side of the profile 13 of the open-cut portion 7.

Figure 30:
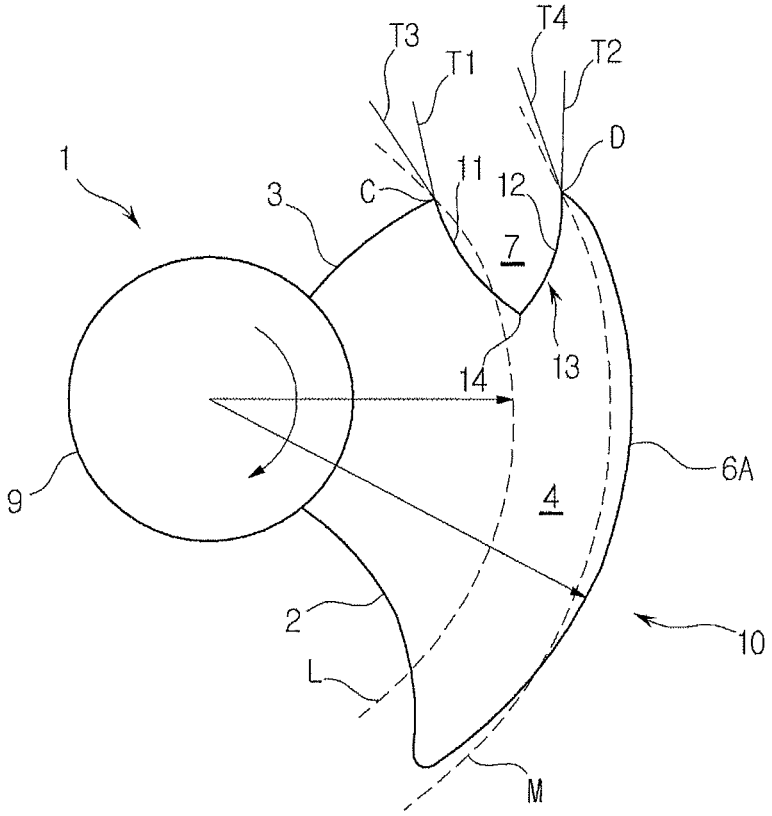
FIG. 30 is the conditions of the arc specifying the shape of the open-cut portion according to the third embodiment, seen from the side of the pressure surface along the axis of rotation of the fan.

In addition, referring to FIG. 30 showing the pressure surface 4 of the blade 10 viewed along the axis of rotation of the fan X, the first arc 11 and the second arc 12 are set such that the angle that tangent lines T1 and T2 of the first arc 11 and the second arc 12 passing through points C and D make with tangent lines T3 and T4 passing through points C and D on circles L and M having the center thereof at the center of rotation O is between −15 degrees and +15 degrees. In other words, when tangent lines T1 and T2 overlap tangent lines T3 and T4, the angle is zero. In addition, the angle is positive when tangent lines T1 and T2 are positioned toward the axis of rotation of the fan with respect to tangent lines T3 and T4, while the angle is negative when tangent lines T1 and T2 are positioned in the opposite side of the direction of rotation of the fan with respect to tangent lines T3 and T4. By setting the angle as above, the degree to which the profile 13 of the open-cut portion 7 is widened backward may be set.

By setting the first arc 11 and the second arc 12 as above and arranging the open-cut portion 7 to be close to the outer circumferential edge 6A of the blade 10, introduction of leaking airflow from the side of the pressure surface 4 to the side of the suction surface 5 at the outer circumferential portion of the blade 10 may be suppressed, and therefore development of vortices at the tip of the blade may be suppressed. In addition, the distance between the central lines 15*b* and 15*d* of the first vortex 15*a* and the second vortex 15*c* spinning in the opposite directions is widened as they extends from the leading end 14 of the open-cut portion 7, as shown in FIG. 8. In other words, by suppressing overlapping of the central lines 15*b* and 15*d* and thus reinforcing interference between the vortices 15*a* and 15*c*, the propulsive power of the blade 10 may be enhanced.

Next, the propeller fan 1 according to the fourth embodiment of the present invention will be described with reference to FIG. 31.

Figure 31:
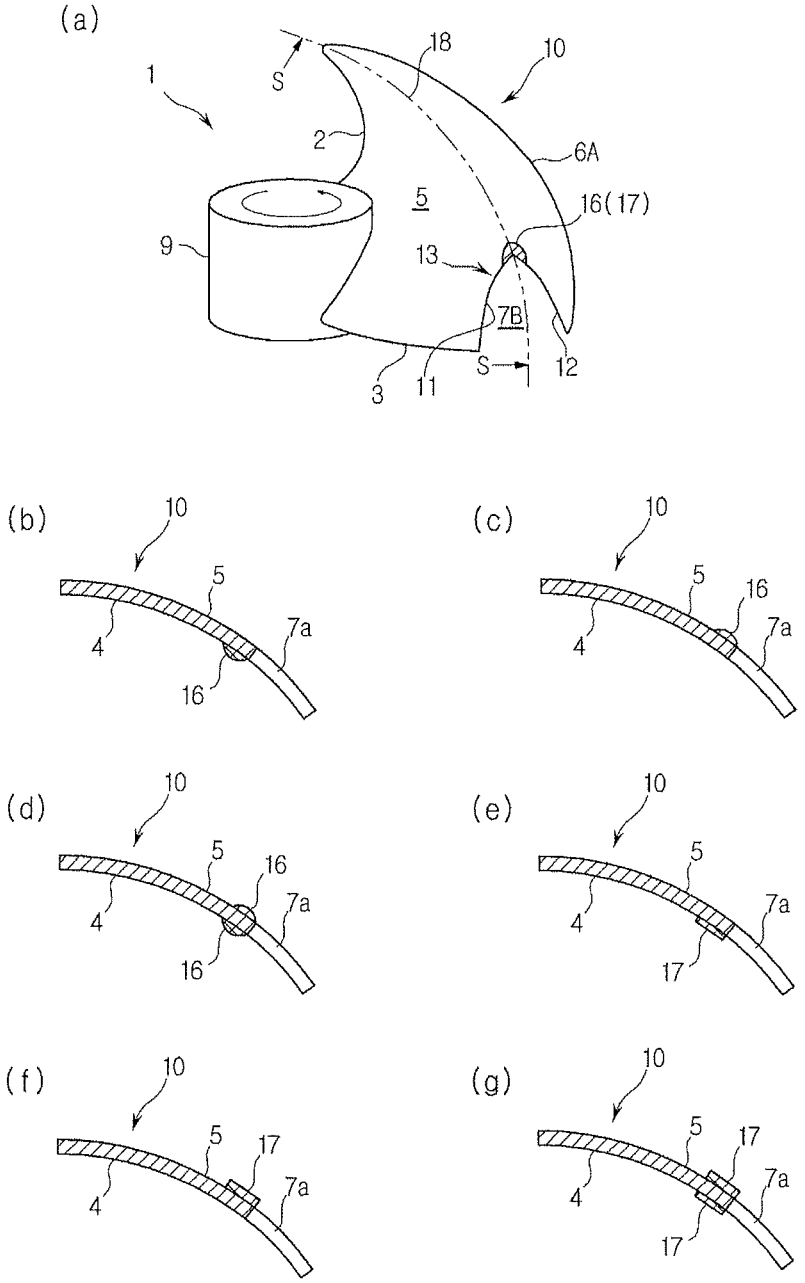
FIG. 31 shows a perspective view of the blade of a propeller fan according to a fourth embodiment of the present invention, seen from the side of the suction surface, and a cross-sectional view of a concave portion according to the fourth embodiment, taken along line S-S of FIG. 31(*a*)

As shown in FIG. 31, in the fourth embodiment, the leading end 14 of the open-cut portion 7B is made thicker than the other portions of the blade by provide a raised portion 16 or a rib 17, which is different from the third embodiment. That is, al parts of the profile 13 of the open-cut portion 7B has the same thickness as the entire blade 10 in the first embodiment, while the leading end 14 of the open-cut portion 7B is made thicker than the other portions in the fourth embodiment.

Hereinafter, the shape of the blade 10 according to the fourth embodiment will be described in detail.

FIG. 31(*a*) is a perspective view illustrating the suction surface 5 of the blade 10 viewed along the axis of rotation of the fan X. FIGS. 31(*b*) to 31(*g*) show a cross section taken along line S-S of FIG. 31(*a*) in the direction of the chord of the blade 10. FIGS. 31(*c*) to 31(*g*) illustrate variations of the leading end 14 of the open-cut portion 7B in the second embodiment.

To increase the thickness of the blade 10, the open-cut portion 7B is provided with a raised portion 16 at the leading end 14 on the pressure surface 4. The raised portion 16 is formed in the shape of a hemisphere having a semicircular cross section or a sphere with two hemispheres having a semicircular cross section. The raised portion 16 extends along the open-cut center line 18 passing through the leading end 14 of the open-cut portion 7B in the direction of rotation (forward and backward directions) of the blade 10. In the case that the propeller fan 1 is made of a metallic or synthetic material, the raised portion 16 is formed of the same material as that of the blade 10. Meanwhile, in FIG. 31, to clearly show the raised portion 16 and the rib 17, oblique lines different from those for the blade 10 have been used.

By increasing the thickness of the leading end 14 of the open-cut portion 7B with the raised portion 16 over the other portions of the blade 10, the start point of the first vortex 15*a* and the second vortex 15*c* spinning in the opposite directions becomes more apparent. Therefore, flow may be controlled as desired, and thus the propulsive power of the blade 10 may be more easily enhanced.

As shown in FIGS. 31(*c*) and 31(*d*), the raised portion 16 may be arranged on the suction surface 5 of the blade 10, or on both the pressure surface 4 and the suction surface 5.

Furthermore, the rib 17 may be provided in place of the raised portion 16. The rib 17 extends along the open-cut center line 18 passing through the leading end 14 of the open-cut portion 7B in the direction of rotation (forward and backward directions) of the blade 10. When the rib 17 is provided, the rib 17 may be arranged on the pressure surface 4 (FIG. 31(*e*)) or the suction surface 5 (FIG. 31(*f*)), or on both the pressure surface 4 and the suction surface 5 (FIG. 31(*g*)). The rib 17 has the same effect as the raised portion 16 arranged at the leading end 14 of the open-cut portion 7.

Figure 32:
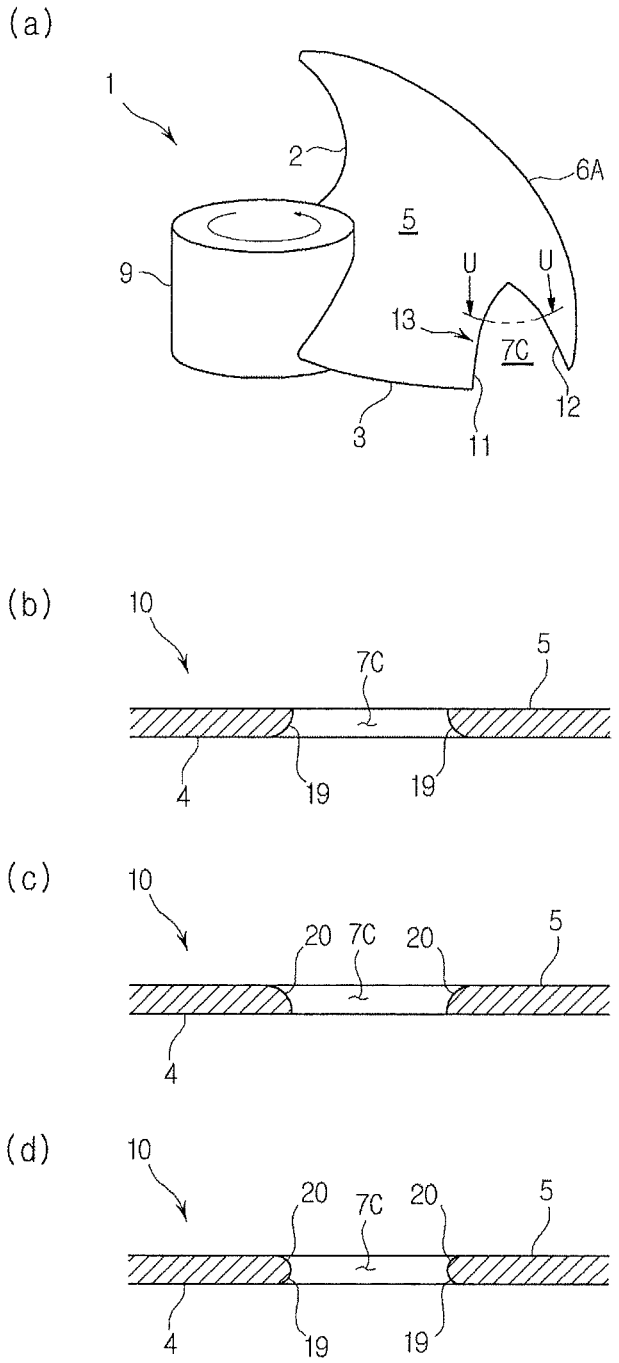
FIG. 32 shows a perspective view of the blade of a propeller fan according to a fifth embodiment of the present invention, seen from the side of the suction surface, and cross-sectional views of a concave portion according to the fifth embodiment and variations thereof, taken along line U-U of FIG. 32(*a*)

Hereinafter, the propeller fan 1 according to the fifth embodiment of the present invention will be described with reference to FIG. 32. FIG. 32(*a*) is a perspective view illustrating the suction surface 5 of the blade 10 viewed along the axis of rotation of the fan X. FIGS. 32(*b*) to 32(*d*) show a cross section taken along line U-U of FIG. 15(*a*) in the radial direction of the blade 10. FIGS. 32(*c*) and 32(*d*) illustrate variations of the fifth embodiment.

In the fifth embodiment, the cross section of the profile 13 of the open-cut portion 7C is formed to be rounded from the pressure surface 4 of the blade 10 to the suction surface 5. That is, the profile 13 of the open-cut portion 7C is formed by the corners defined as the pressure surface 4 and the suction surface 5 of the blade 10 adjoin the sidewall 7*a* of the open-cut portion 7C. As shown in FIG. 32(*b*), by chamfering the corner on the side of the pressure surface 4, a chamfered portion 19 having a rounded cross section is formed. By rounding a portion of the profile 13, the vortices may be quickly produced. Therefore, interference between the first vortex 15*a* and the second vortex 15*c* spinning in the opposite direction at the open-cut portion 7 may be promoted and thus the propulsive power of the blade 10 may be enhanced.

In variations of the fifth embodiment as shown in FIGS. 32(*c*) and 32(*d*), a chamfered portion 20 may be provided to a corner of the open-cut portion 7C at the side of the suction surface 5 such that the profile 13 has a rounded cross section extending from the suction surface 5 of the blade 10 toward the pressure surface 4 (FIG. 32(*c*)), or and chamfered portions 19 and 20 may be provided to the corners at the sides of the pressure surface 4 and the suction surface 5 such that the profile 13 has a cross section having rounded portions on the sides of the pressure surface 4 and the suction surface 5 of the blade 10 (FIG. 32(*d*)). This configuration has the same effect as the above.

Figure 33:
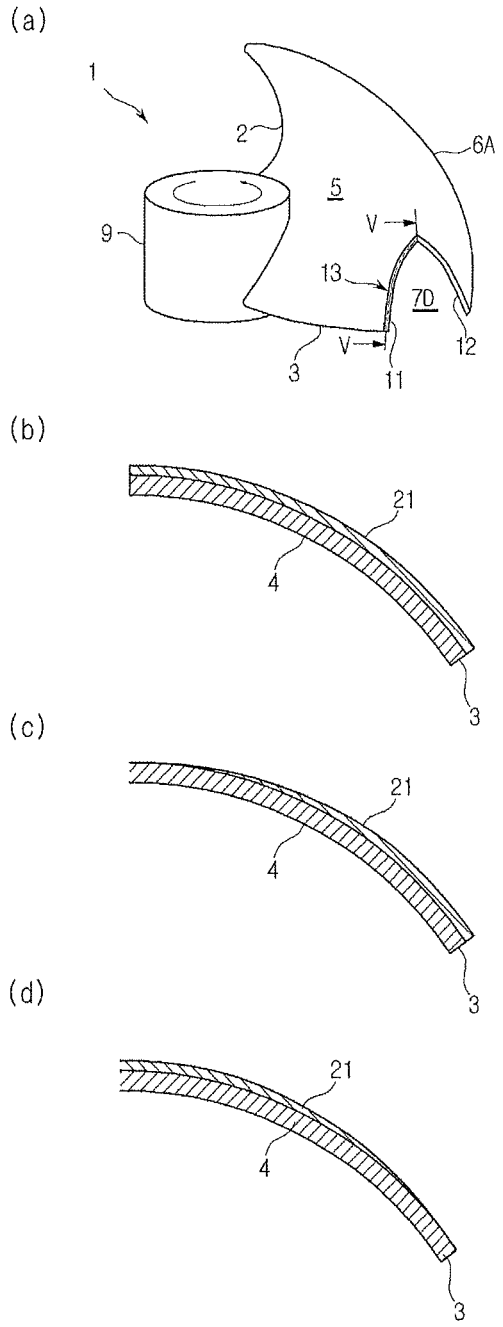
FIG. 33 shows a perspective view of the blade of a propeller fan according to a six embodiment of the present invention, seen from the side of the suction surface, and cross-sectional views of a concave portion according to the sixth embodiment and variations thereof, taken along line V-V of FIG. 33(*a*)

Hereinafter, a propeller fan 1 according to the sixth embodiment will be described with reference to FIG. 33. FIG. 33(*a*) is a perspective view illustrating the suction surface 5 of the blade 10 viewed along the axis of rotation of the fan X, and FIGS. 33(*b*) to 33(*d*) are cross-sectional views of the profile 13 of the open-cut portion 7D, taken along line V-V of FIG. 33(*a*). FIGS. 33(*c*) and 33(*d*) illustrate variations of the sixth embodiment.

As shown in FIG. 33(*a*), in the sixth embodiment, a long raised portion 21 is arranged along the profile 13 of the open-cut portion 7D on the suction surface 5 of the blade 10. In other words, the long raised portion 21 is formed along the first arc 11 and the second arc 12 of the open-cut portion 7D, i.e., along the profile 13. In the sixth embodiment, the long raised portion 21 having a constant thickness is formed over the entire length of the profile 13 of the open-cut portion 7D. Thickness of the long raised portion 21 may be equal to or less than the thickness of the blade 10. In the case that the propeller fan 1 is made of a metallic or synthetic material, the long raised portion 21 may be integrated with the blade 10, and the cross section thereof may be of a semicircular shape.

By arranging the long raised portion 21 along the profile 13 on the suction surface 5 such that the long raised portion 21 has a constant height over the entire length thereof, interference between the first vortex 15*a* and the second vortex 15*c* spinning in the opposite directions may be uniformly intensified. Thereby, the propulsive power of the blade 10 may be enhanced.

In place of the long raised portion 21, a rib having a cross section of a quadrangular (square or rectangular) shape may be arranged along the profile 13 of the open-cut portion 7C on the suction surface 5 of the blade 10.

In addition, the height of the raised portion 21 (or rib) may gradually increase from the leading edge 2 of the blade 10 to the trailing edge 3, as shown in FIG. 33(*c*). According to this configuration, interference between the first vortex 15*a* and the second vortex 15*c* spinning in the opposite directions may be gradually intensified. Thereby, the propulsive power of the blade 10 may be enhanced.

Alternatively, the height of the raised portion 21 (or rib) may gradually decrease from the leading edge 2 of the blade 10 to the trailing edge 3, as shown in FIG. 33(*d*). According to this configuration, mutual interference between the first vortex 15*a* and the second vortex 15*c* spinning in the opposite directions may be intensified immediately after the first vortex 15*a* and the second vortex 15*c* are produced. Thereafter, the flows are formed along the paths where the first and second vortices 15*a* and 15*c* are easily interfered with each other. Thereby, the propulsive power of the blade 10 may be enhanced.

Figure 34:
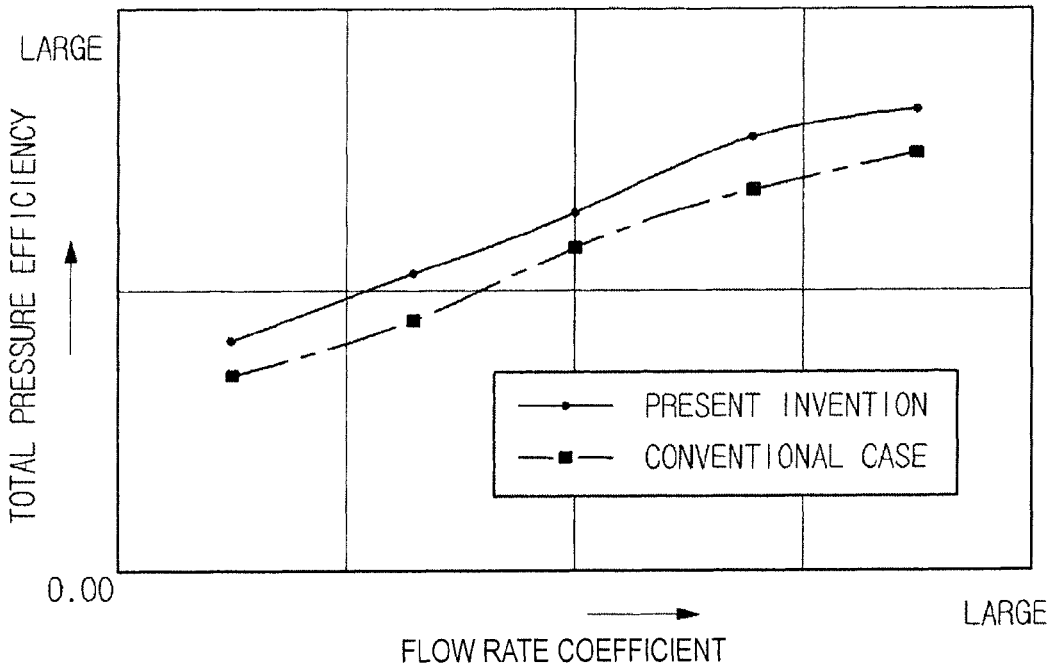
FIG. 34 is a graph depicting the fan efficiencies of the propeller fan of the present invention and a conventional propeller fan in a comparative manner.

Referring to FIG. 34 showing a graph of fan efficiencies, in which the axis of ordinates indicates the total pressure efficiency and the abscissa indicates the flow rate coefficient, it can be seen that the total pressure efficiency of the propeller fan 1 of the present invention has increased from that of the conventional propeller fan by more than 10%, for all flow rate coefficients.

The propeller fan 1 of the present invention may be applicable to an axial-flow fan and a mixed flow fan, and even to a ventilation system.

The profile 13 of the open-cut portion 7 has been illustrated in the above embodiment as being formed in the shape of a circular arc. However, embodiments of the present invention are not limited thereto. One part of the profile 13 may be formed in the shape of a circular arc, and the other part of the profile 13 may be formed by an oval arc. Alternatively, one part of the profile 13 may be formed in the shape of an oval arc, and the other part of the profile 13 may be a part of a parabola. Alternatively, both parts of the profile may be a combination of various types of arcs. For example, both parts may be formed in the shape of an oval arc, or may be a part of parabola or hyperbola.

In addition, various combinations or variations of the embodiments which do not depart from the spirit of the present invention are also available.

As is apparent from the above description, according to an embodiment of a propeller fan of the present invention, when the radial cross section of a recessed portion arranged on the blade is viewed, the recessed portion is provided with a pair of lateral portions raised at a predetermined angle with respect to the suction surface and facing each other, and the span-wise width between the lateral portions gradually increases from the upstream side to the downstream side. Thereby, the flow near the pressure surface may be strongly drawn to the recessed portion at the blade trailing edge portion. Accordingly, the flow, which usually tends to be inclined toward the outer diameter side, may be almost uniformly distributed, at the trailing edge portion, in the radial direction, and therefore the pressure efficiency may be greatly improved.

In addition, according to another embodiment, the blade is provided with an open-cut portion formed by cutting off a part of the trailing edge portion, and the profile of the open-cut portion is configured with a first arc swollen toward the inner circumferential side of the blade and a second arc swollen toward the outer circumferential side of the blade. Since the leading end of the open-cut portion is formed by connection between a distal end of the first arc distant from the trailing edge portion and a distal end of the second arc distant from the trailing edge portion, the airflow introduced into the open-cut portion from the pressure surface side of the profile to the suction surface side creates vortices spinning in the opposite directions along the first and second arcs. Accordingly, the propulsive power of the blade may be enhanced by mutual interference between the first vortex and the second vortex, and leaking of airflow at the outer circumferential portion of the blade may be reduced. Therefore, development of vortices at the blade tip may be suppressed and thus the fan efficiency may be improved. As a result, the pressure efficiency may be greatly increased.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A propeller fan comprising:

a plurality of blades radially arranged on an outer circumferential surface of a cylindrical hub and spaced a predetermined distance from each other in a circumferential direction of the hub, wherein each of the blades is provided with a recessed portion raised toward a suction surface at a central portion of a trailing edge of the blade in a radial direction such that the recessed portion is open at least on a pressure surface of the blade, the recessed portion extending from the trailing edge toward a leading edge of the blade, a cross section of the recessed portion taken in a radial direction is provided with a pair of lateral portions rising at a predetermined angle with respect to the suction surface and facing each other, a span-wise width of the recessed portion between the lateral portions increases as the recessed portion extends from an upstream side to a downstream side, and when an inclination angle of one of the lateral portions positioned at an inner diameter side with respect to an axis of rotation of the fan is defined as $\theta i$, and an inclination angle of the other one of the lateral portions positioned at an outer diameter side with respect to an axis of rotation of the fan is defined as $\theta o$, the recessed portion meets the conditions of approximately $5° \leq \theta i \leq 60°$, $5° \leq \theta o \leq 60°$, and $\theta i \geq \theta o$.

2. The propeller fan according to claim 1, wherein, when an outer diameter of the blade is defined as Rt with respect to an axis of rotation of the fan, an inner diameter of the blade as Rh, a radius to an end of one of the lateral portions arranged closer to an inner diameter side at the trailing edge of the blade as Ri, and a radius to an end of the other one of the lateral portions closer to an outer diameter side and arranged at the trailing edge of the blade as Ro, the recessed portion is formed such that $Ri=Rh+\alpha(Rt-Rh)$ and $Ro=Rh+\beta(Rt-Rh)$, where $0.2 \leq \alpha < 0.6$, $0.6 \leq \beta \leq 0.9$.

3. The propeller fan according to claim 1, wherein, in a cross section of the recessed portion taken, at a radius where a proximal end of the recessed portion with respect to the leading edge is positioned, along a circumferential direction and, a length of the recessed portion from the trailing edge to the proximal end of the recessed portion (L1) is set to be approximately 10% to 60% of a length of a chord of the blade (L0).

4. The propeller fan according to claim 1, wherein the pressure surface is connected to each of the lateral portions in a rounded fashion.

5. An air conditioner using the propeller fan according to claim 1.

6. A propeller fan comprising:

a plurality of blades radially arranged on an outer circumferential surface of a cylindrical hub and spaced a predetermined distance from each other in a circumferential direction of the hub, wherein each of the blades is provided with a recessed portion raised toward a suction surface at a central portion of a trailing edge of the blade in a radial direction such that the recessed portion is open at least on a pressure surface of the blade, the recessed portion extending from the trailing edge toward a leading edge of the blade, a cross section of the recessed portion taken in a radial direction is provided with a pair of lateral portions rising at a predetermined angle with respect to the suction surface and facing each other, a span-wise width of the recessed portion between the lateral portions increases as the recessed portion extends from an upstream side to a downstream side, in a cross section of the recessed portion taken, at a radius where a proximal end of the recessed portion with respect to the leading edge is positioned along a circumferential direction and, a length of the recessed portion from the trailing edge to the proximal end of the recessed portion (L1) is set to be approximately 10% to 60% of a length of a chord of the blade (L0), and in the cross section of the recessed portion taken at the radius where the proximal end of the recessed portion is positioned, a depth (d) of the recessed portion extending toward the suction surface increases as the recessed portion extends from the upstream side to the downstream side, and the recessed portion has a constant depth region near the trailing edge where the depth (d) is substantially constant as a predetermined depth (dx).

7. The propeller fan according to claim 6, wherein the predetermined depth (dx) is set to be approximately 2% to 10% of the length of the chord (L0).

8. A propeller fan comprising:

a plurality of blades radially arranged on an outer circumferential surface of a cylindrical hub and spaced a predetermined distance from each other in a circumferential direction of the hub, wherein each of the blades is provided with a recessed portion raised toward a suction surface at a central portion of a trailing edge of the blade in a radial direction such that the recessed portion is open at least on a pressure surface of the blade, the recessed portion extending from the trailing edge toward a leading edge of the blade, a cross section of the recessed portion taken in a radial direction is provided with a pair of lateral portions rising at a predetermined angle with respect to the suction surface and facing each other, a span-wise width of the recessed portion between the lateral portions increases as the recessed portion extends from an upstream side to a downstream side, and the recessed portion is provided with a bottom portion formed at the suction surface sides of the lateral portions to close the recessed portion, wherein the bottom portion forms a curved surface approximately parallel to the suction surface.

9. A propeller fan comprising:

a plurality of blades radially arranged on an outer circumferential surface of a cylindrical hub and spaced a predetermined distance from each other in a circumferential direction of the hub, wherein each of the blades is provided with a recessed portion raised toward a suction surface at a central portion of a trailing edge of the blade in a radial direction such that the recessed portion is open at least on a pressure surface of the blade, the recessed portion extending from the trailing edge toward a leading edge of the blade, a cross section of the recessed portion taken in a radial direction is provided with a pair of lateral portions rising at a predetermined angle with respect to the suction surface and facing each other, a span-wise width of the recessed portion between the lateral portions increases as the recessed portion extends from an upstream side to a downstream side, and the recessed portion is open on the suction surface to have an opening and is configured only with the lateral portions.

10. The propeller fan according to claim 9, wherein an upstream end of the opening of the recessed portion is rounded.

11. The propeller fan according to claim 10, wherein the recessed portion is provided with a filling portion formed by filling a gap between upstream ends of the lateral portions, wherein the filling portion forms the same curved surface with a portion of the pressure surface adjacent thereto.

12. A propeller fan comprising:

a plurality of blades radially arranged on an outer circumferential surface of a cylindrical hub and spaced a predetermined distance from each other in a circumferential direction of the hub, wherein each of the blades is provided with a recessed portion raised toward a suction surface at a central portion of a trailing edge of the blade in a radial direction such that the recessed portion is open at least on a pressure surface of the blade, the recessed portion extending from the trailing edge toward a leading edge of the blade, a cross section of the recessed portion taken in a radial direction is provided with a pair of lateral portions rising at a predetermined angle with respect to the suction surface and facing each other, a span-wise width of the recessed portion between the lateral portions increases as the recessed portion extends from an upstream side to a downstream side, each of the plurality of blades is provided with at least one open-cut portion formed by cutting off a trailing edge of the blade, and a profile of the open-cut portion is provided with a first arc swollen toward an inner circumference of the blade and a second arc swollen toward an outer circumference of the blade, wherein a leading end of the profile is formed by connection between a distal end of the first arc distant from the trailing edge portion and a distal end of the second arc distant from the trailing edge portion.

13. The propeller fan according to claim 12, wherein, when a center of rotation of the propeller fan is defined as O, a radius from the center of rotation O to the outer circumference of the blade as R1, a radius of the hub as R2, two connection points at which the trailing edge of the blade meets the profile of the open-cut portion as P and Q, one of the two connection points close to the center of rotation O being defined as P and the other one of two connection points distant from the center of rotation O being defined as Q, a length of line segment OP between the center of rotation O and point P as Rp, and a length of line segment OQ between the center of rotation O and point Q as Rq, the first arc and the second arc forming the profile of the open-cut portion are formed such that $0.35(R1-R2)\leq(Rp-R2)<(Rq-R2)\leq(R1-R2)$.

14. The propeller fan according to claim 12, wherein the blade is provided with only one of the at least one open-cut portion.

15. The propeller fan according to claim 12, wherein the profile of the open-cut portion is provided with a circular arc between the first and second arcs.

16. The propeller fan according to claim 12, wherein the first and second arcs are circular arcs, wherein a line segment between a point A dividing the first circular arc into two equal parts and a center of the first circular arc crosses a line segment between a point B dividing the second circular arc into two equal parts and a center of the second circular arc.

17. The propeller fan according to claim 16, wherein, when a point at which the line segment between the point A on the first circular arc and the center of the first circular arc crosses the line segment between the point B on the second circular arc and the center of the second circular arc is defined as point F, the point F is positioned at an inner side of the profile of the open-cut portion.

18. The propeller fan according to claim 12, wherein the first and second arcs are circular arcs, wherein a first tangent line to the first circular arc at a first connection point and a second tangent line to the second circular arc at a second connection point make an angle respectively with imaginary tangent lines, at the first connection point and the second connection point, to imaginary circles passing through the first connection point and the second connection point and having a center thereof at a center of rotation of the propeller fan, the first circular arc meeting the trailing edge at the first connection point, the second arc meeting the trailing edge at the second connection point, and the angle being between −15 degrees and +15 degrees.

19. The propeller fan according to claim 18, wherein a raised portion or rib is provided to the pressure surface of the blade, at and around a connection point of the first and second arcs at the leading end of the profile of the open-cut portion.

20. The propeller fan according to claim 19, wherein another raised portion or rib is provided to the suction surface of the blade, at and around the connection point of the first and second arcs at the leading end of the profile of the open-cut portion.

21. The propeller fan according to claim 20, wherein a radial cross section of the profile of the open-cut portion has a rounded corner extending from the pressure surface of the blade toward the suction surface.

22. The propeller fan according to claim 20, wherein a radial cross section of the profile of the open-cut portion has a rounded corner extending from the suction surface of the blade toward the pressure surface.

23. The propeller fan according to claim 20, wherein the another raised portion or rib is provided to the suction surface of the blade along the profile of the open-cut portion.

24. The propeller fan according to claim 23, wherein a height of the another raised portion or rib is constant as the another raised portion or rib extends from the leading edge of the blade toward the trailing edge.

25. The propeller fan according to claim 23, wherein a height of the another raised portion or rib gradually increases as the another raised portion or rib extends from the leading edge of the blade toward the trailing edge.

26. The propeller fan according to claim 23, wherein a height of the another raised portion or rib gradually decreases as the another raised portion or rib extends from the leading edge of the blade toward the trailing edge.

27. An air conditioner using the propeller fan according to claim 12.

* * * * *